US009878542B2

(12) United States Patent
Mizutani et al.

(10) Patent No.: US 9,878,542 B2
(45) Date of Patent: Jan. 30, 2018

(54) PRINT DEVICE

(71) Applicant: BROTHER KOGYO KABUSHIKI KAISHA, Nagoya-shi, Aichi-ken (JP)

(72) Inventors: Toshiaki Mizutani, Kasugai (JP); Katsunori Nishida, Toyoake (JP); Takao Hyakudome, Nagoya (JP); Haruo Kobayashi, Ichinomiya (JP); Goro Okada, Nagoya (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/465,074

(22) Filed: Mar. 21, 2017

(65) Prior Publication Data

US 2017/0282566 A1 Oct. 5, 2017

(30) Foreign Application Priority Data

Mar. 31, 2016 (JP) ..... 2016-073202

(51) Int. Cl.
*B41J 2/165* (2006.01)
*B41J 2/175* (2006.01)
*B41J 2/19* (2006.01)

(52) U.S. Cl.
CPC ..... *B41J 2/16505* (2013.01); *B41J 2/17596* (2013.01); *B41J 2/19* (2013.01)

(58) Field of Classification Search
CPC ..... B41J 2/16523; B41J 2/16532; B41J 2/16535; B41J 2/1714
USPC ..... 347/6, 20, 22, 29, 30, 33, 36, 84, 85
See application file for complete search history.

(56) References Cited

U.S. PATENT DOCUMENTS

| | | | | |
|---|---|---|---|---|
| 7,901,033 | B2 * | 3/2011 | Nishida | B41J 2/16508 347/22 |
| 9,085,156 | B1 * | 7/2015 | Kobayashi | B41J 2/16511 |
| 9,427,971 | B2 * | 8/2016 | Kobayashi | B41J 2/16508 |
| 2016/0031222 | A1 | 2/2016 | Kobayashi | |

FOREIGN PATENT DOCUMENTS

| | | |
|---|---|---|
| JP | 2000-062213 A | 2/2000 |
| JP | 2016-030382 A | 3/2016 |

OTHER PUBLICATIONS

Co Pending U.S. Appl. No. 15/465,024, filed Mar. 21, 2017.

* cited by examiner

*Primary Examiner* — An Do
(74) *Attorney, Agent, or Firm* — K&L Gates LLP

(57) ABSTRACT

A print device includes a processor, and a memory. The processor performs processes. The processes include a covering control processing controlling the cap into a covering state in which the cap covers the nozzle. The processes include supply processing supplying, after the covering control processing, the cleaning liquid to the cap from the supply flow path. The processes include hold processing holding, after the supply processing and in a state in which the cleaning liquid has soaked the nozzle face, the cleaning liquid in the cap. The processes include first determination processing determining, after the hold processing, whether a print request has been received. The processes include discharge processing discharging, in a case where a power on signal has been detected or in a case where the first determination processing has determined that the print request has been received, the cleaning liquid that has been held in the cap.

8 Claims, 18 Drawing Sheets

PRINT DEVICE

CROSS-REFERENCE TO RELATED APPLICATION

This application claims priority to Japanese Patent Application No. 2016-073202 filed on Mar. 31, 2016, the disclosure of which is herein incorporated by reference in its entirety.

BACKGROUND

The present disclosure relates to a print device.

An inkjet recording device is known that performs a maintenance operation that cleans a nozzle face. When the inkjet recording device performs the maintenance operation, the inkjet recording device tightly affixes a cap to the nozzle face of a print head and, by operating a suction device, sucks ink from a nozzle that is provided in the nozzle face. Next, the inkjet recording device injects a cleaning liquid into the cap. Next, the inkjet recording device pulls the cap away from the nozzle face and wipes the nozzle face with a wiping device.

SUMMARY

If a long time passes during which the ink is not discharged from the nozzle, there is a possibility that the ink will dry out and clog the nozzle, causing discharge failures to occur. That creates the possibility that, when the ink is once again discharged from the nozzle, discharge processing for the dried ink will take a long time, as well as the possibility that a large amount of the ink will be discharged during the discharge processing. The possibility must also be considered that the discharge failures will not be eliminated even if the discharge processing is performed.

Various embodiments of the general principles described herein provide a print device that reduces the possibility that failures of discharge from the nozzle will occur.

Embodiments herein provide a print device that includes a head, a cap, a supply flow path, a supply valve, a waste liquid flow path, a pump, a processor, and a memory. The head is provided with a nozzle face having a nozzle. The cap is configured to be affixed to the nozzle face and cover the nozzle. The supply flow path is connected to the cap and is configured to supply a cleaning liquid to the interior of the cap. The supply valve is provided in the supply flow path and configured to open and close the supply flow path. The waste liquid flow path is connected to the cap and is configured to drain off the cleaning liquid that has been supplied to the interior of the cap. The pump is connected to the waste liquid flow path. The memory storing computer-readable instructions which, when executed by the processor, perform processes. The processes include covering control processing controlling the cap into a covering state in which the cap covers the nozzle. The processes include supply processing supplying, after the covering control processing, the cleaning liquid to the cap from the supply flow path by opening the supply valve and operating the pump. The processes include hold processing holding, after the supply processing and in a state in which the cleaning liquid has soaked the nozzle face, the cleaning liquid in the cap by closing the supply valve and stopping the pump. The processes include first determination processing determining, after the hold processing, whether a print request has been received. The processes include discharge processing discharging, in a case where a power on signal has been detected or in a case where the first determination processing has determined that the print request has been received, the cleaning liquid that has been held in the cap to the waste liquid flow path by operating the pump.

BRIEF DESCRIPTION OF THE DRAWINGS

Embodiments will be described below in detail with reference to the accompanying drawings in which.

DETAILED DESCRIPTION

Figure 1:
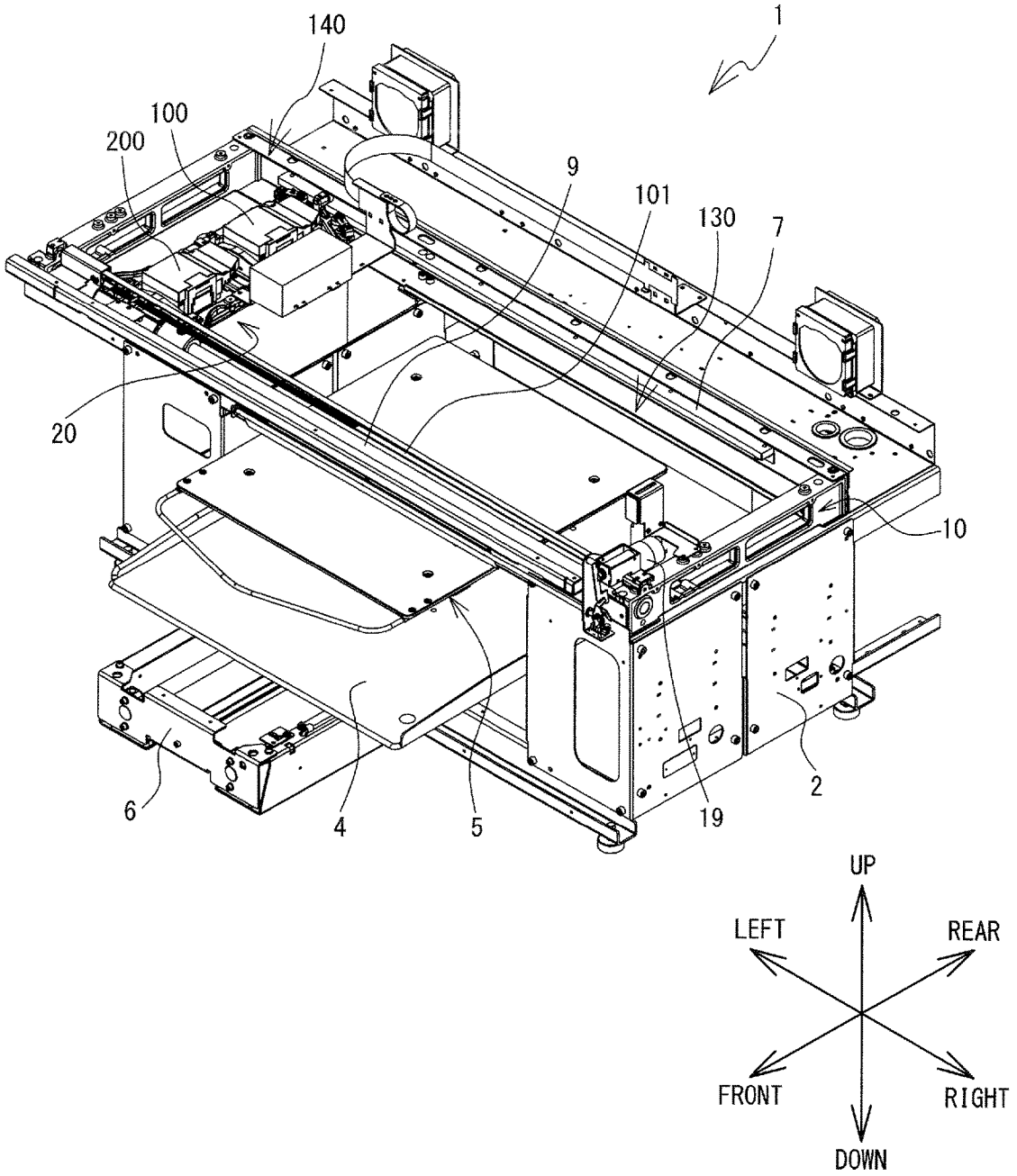
FIG. 1 is an oblique view of a printer.

The configuration of a printer 1 will be explained with reference to FIGS. 1 to 7. The top side, the bottom side, the lower left side, the upper right side, the lower right side, and the upper left side in FIG. 1 respectively correspond to the top side, the bottom side, the front side, the rear side, the right side, and the left side of the printer 1.

Mechanical Configuration of the Printer 1

The printer 1 is an inkjet printer that performs printing by discharging liquid inks 91 (refer to FIG. 12) from nozzles 112 onto a cloth such as a T-shirt or the like that is a printing medium (not shown in the drawings). The printing medium may also be a paper or the like. The printer 1 prints a color image on the printing medium by discharging downward five different types of the inks 91 (white (W), black (K), yellow (Y), cyan (C), and magenta (M)), for example. In the explanation that follows, among the five different types of the inks 91, the white ink 91 will be called the white ink. The other four types of the inks 91, black, cyan, yellow, and magenta, will be collectively called the color inks. The white ink is an ink that is more prone to sedimentation than are the color inks. The white ink is also more prone to discharge failures than are the color inks, due to clogging inside the nozzles 112.

As shown in FIG. 1, the printer 1 is provided with a housing 2, a platen drive mechanism 6, a pair of guide rails (not shown in the drawings), a platen 5, a tray 4, a frame body 10, a guide shaft 9, a rail 7, a carriage 20, head units 100, 200, a drive belt 101, and a drive motor 19.

An control portion (not shown in the drawings) that performs operations of the printer 1 is provided in a position on the right front side of the housing 2. The operation portion is provided with a display 49 (refer to FIG. 6) and operation buttons 501 (refer to FIG. 6). An operator operates the operation buttons 501 when inputting commands that pertain to various operations of the printer 1. A power off command that turns off a power supply 56 (refer to FIG. 6) and the power on command that turns on the power supply 56 are also input by specific operations of the operation buttons 501. Pressing and holding the operation buttons 501 is one example of a specific operation.

The frame body 10 has a frame shape that is substantially rectangular in a plan view, and the frame body 10 is installed in the top portion of the housing 2. The frame body 10 supports the guide shaft 9 on the front side of the flame body 10 and supports the rail 7 on the rear side of the flame body 10. The guide shaft 9 extends from left to right on the inner side of the frame body 10. The rail 7 is provided opposite the guide shaft 9 and extends from left to right.

Figure 2:
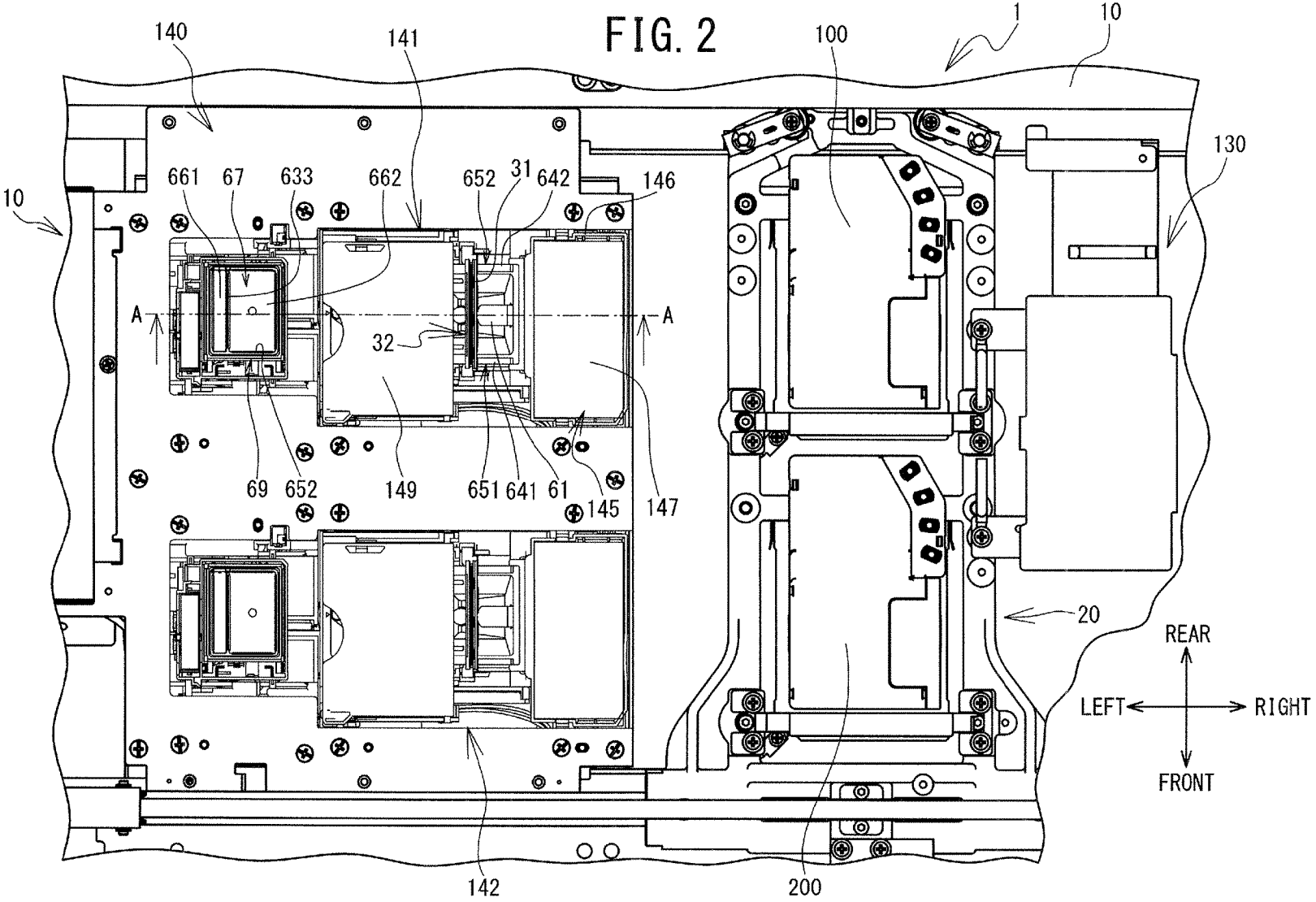
FIG. 2 is a plan view of the printer.
Figure 3:
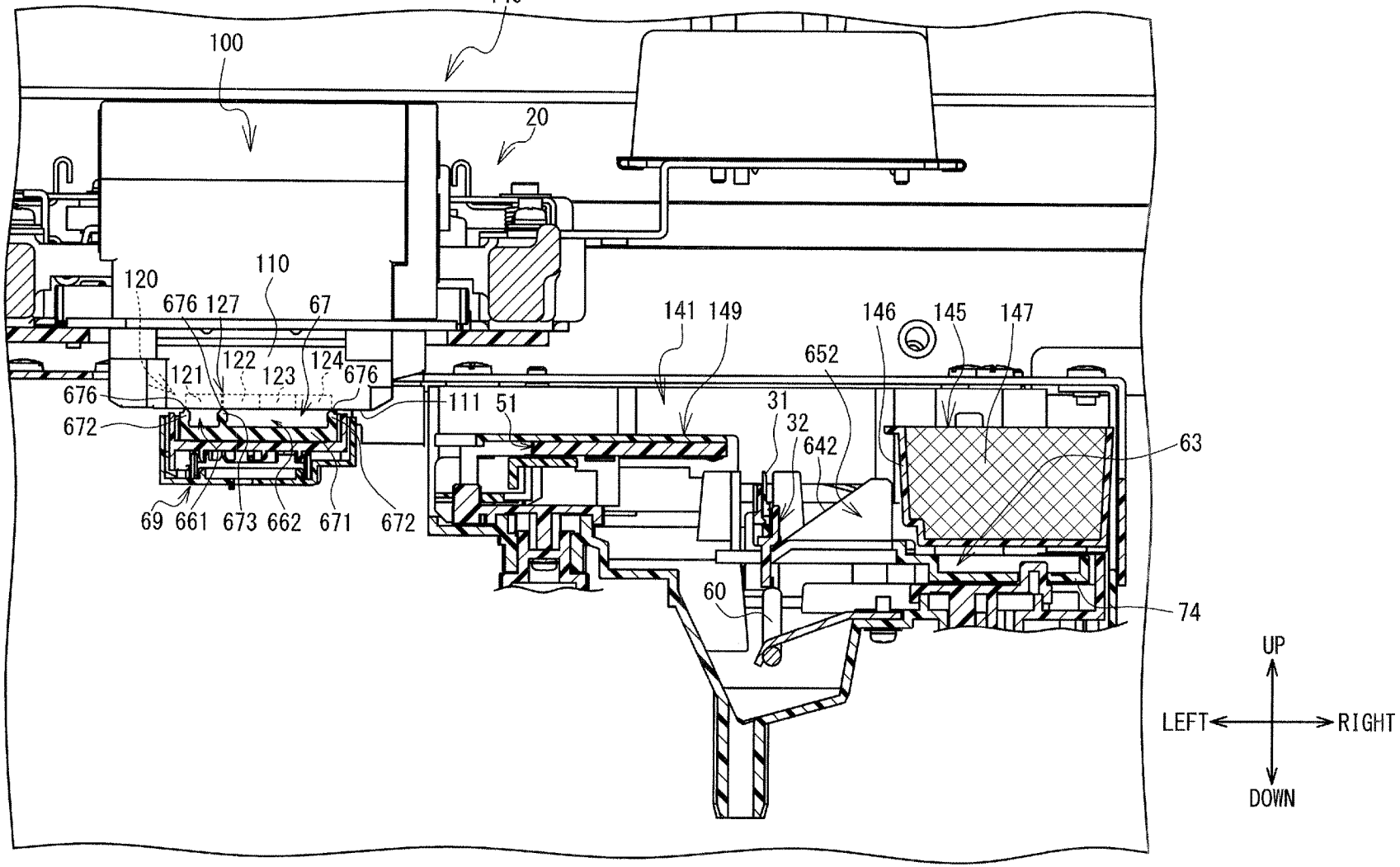
FIG. 3 is a section view along the line A-A in FIG. 2, when a wiper is in a wiper withdrawn position and a cap is in a covering position.

The carriage 20 is supported such that the carriage 20 can be conveyed to the left and the right along the guide shaft 9. As shown in FIGS. 1 and 2, the head units 100, 200 are carried on the carriage 20 and are arrayed in the front-rear direction. The head unit 100 is provided to the rear of the head unit 200. As shown in FIG. 3, the bottom portions of the head units 100, 200 are each provided with a head 110. The head 110 of the head unit 100 discharges the white ink. The head 110 of the head unit 200 discharges the color inks.

Each of the heads 110 is provided with a nozzle face 111, which is a face that has a plurality of the tiny nozzles 112 (refer to FIG. 12) that are capable of discharging the inks 91 downward. The nozzle faces 111 are flat surfaces that extend in the left-right direction and the front-rear direction, and the nozzle faces 111 form the bottom faces of the head units 100, 200. The plurality of the nozzles 112 in the nozzle face 111 are provided in a nozzle disposition area 120. The nozzle disposition area 120 is provided in the central portion of the left-right direction of the nozzle face 111 and extends in the front-rear direction.

The nozzle face 111 has nozzle arrays 121 to 124. Each one of the nozzle arrays 121 to 124 is an array of a plurality of the nozzles 112. The nozzle arrays 121 to 124 are provided in four separate areas in the left-right direction of the nozzle disposition area 120. The nozzle arrays 121 to 124 are arrayed as the nozzle array 121, the nozzle array 122, the nozzle array 123, and the nozzle array 124, in that order from left to right.

The nozzle arrays 121 to 124 of the head unit 100 are nozzle arrays that are capable of discharging the white ink. Each one of the nozzle arrays 121 to 124 of the head unit 100 is connected through a different white ink supply tube (not shown in the drawings), for example, to at least one cartridge (not shown in the drawings) that stores the white ink.

Each one of the nozzle arrays 121 to 124 of the head unit 200 is connected through a different color ink supply tube (not shown in the drawings) to an ink cartridge (not shown in the drawings) that stores the corresponding one of the color inks. For example, the nozzle array 121 is connected to a black ink cartridge, the nozzle array 122 is connected to a yellow ink cartridge, the nozzle array 123 is connected to a cyan ink cartridge, and the nozzle array 124 is connected to a magenta ink cartridge.

As shown in FIG. 1, the drive belt 101 spans the inner side of the frame body 10 in the left-right direction. The drive motor 19 is coupled to the carriage 20 through the drive belt 101. The carriage 20 is moved reciprocally to the left and the right along the guide shaft 9 by the driving of the drive belt 101 by the drive motor 19.

The platen drive mechanism 6 is provided with the pair of the guide rails (not shown in the drawings) and a platen support base (not shown in the drawings). The pair of the guide rails extend from the front to the rear on the inner side of the platen drive mechanism 6 and support the platen support base such that the platen support base can move toward the front and the rear. The top portion of the platen support base supports the platen 5. The platen 5 supports the printing medium.

The tray 4 is provided below the platen 5. When the operator places a T-shirt or the like on the platen 5, the tray 4 receives the sleeves and the like of the T-shirt, thus protecting the sleeves and the like, such that the sleeves and the like do not come into contact with other parts in the interior of the housing 2.

The platen drive mechanism 6 is driven by a sub scanning direction drive portion 46 that will be described later (refer to FIG. 6). When the platen drive mechanism 6 is thus driven, the platen drive mechanism 6 moves the platen support base and the platen 5 toward the front and the rear along the pair of the guide rails. As the platen 5 conveys the printing medium in the front-rear direction (the sub scanning direction), the inks 91 are discharged from the heads 110 as the heads 110 move reciprocally in the left-right direction (a main scanning direction). The printer 1 thus performs printing on the printing medium.

Along the path that the heads 110 travel, the area where the heads 110 perform printing will be called the printing area 130, as shown in FIGS. 1 and 2. The area along the path that the heads 110 travel that is outside the printing area 130 will be called the non-printing area 140. The non-printing area 140 is an area in the left portion of the printer 1, for example. The printing area 130 is the area from the right edge of the non-printing area 140 to the right end of the printer 1. The platen 5 and the tray 4 are provided in the printing area 130.

Various types of maintenance operations for ensuring printing quality are performed in the non-printing area 140. For example, the maintenance operations include a flushing operation, an ink purge operation, a cleaning operation, a nozzle face wiping operation, a wiper wiping operation, and the like. The flushing operation is an operation that, before printing is performed on the printing medium, discharges the inks 91 from the nozzles 112 onto a flushing receiving portion 145 that will be described later (refer to FIG. 2). Performing the flushing operation causes the inks 91 to be discharged appropriately from the nozzles 112 immediately after the printing starts. The ink purge operation is an operation (refer to FIG. 12) in which, in a state in which the areas around the nozzle faces 111 are covered by caps 67 that will be described later (refer to FIG. 2), the inks 91 are pulled out of the nozzles 112 by a suction pump 708 that will be described later. The ink purge operation discharges, along with the inks 91, any air bubbles that have gotten inside the nozzles 112, for example. It is therefore possible to decrease the possibility that the air bubbles will cause an ink discharge problem to occur. The cleaning operation is an operation that uses a cleaning liquid 92 to clean the nozzle faces 111 to which the inks 91 have adhered (refer to FIG. 13). Note that the inks 91 have a greater viscosity than does the cleaning liquid 92.

The nozzle face wiping operation is an operation in which wipers 31 that will be described later wipe off the excess inks 91 and the excess cleaning liquid 92 that are remaining on the surfaces of the nozzle faces 111 (refer to FIG. 4). When the inks 91 that are remaining on the nozzle faces 111 harden and bind to the nozzle faces 111, for example, there is a possibility that it will become difficult for the inks 91 to be discharged from the nozzle faces 111. That possibility can be decreased by performing the nozzle face wiping operation. When the inks 91 and the cleaning liquid 92 that are remaining on the nozzle faces 111 make their way into the nozzles 112, for example, there is a possibility that the meniscuses that are formed in the nozzles 112 will be affected. That possibility can also be decreased by performing the nozzle face wiping operation. The wiper wiping operation is an operation in which absorption members 51 that will be described later wipe off the inks 91 that are adhering to the wipers 31 (refer to FIG. 5). Even if the inks 91 and the cleaning liquid 92 that have been wiped off of the nozzle faces 111 are adhering to the wipers 31, the performing of the wiper wiping operation is able to decrease the possibility that the inks 91 and the cleaning liquid 92 from the wipers 31 will adhere to the nozzle faces 111 the next time that the nozzle face wiping operation is performed.

As shown in FIG. 2, the non-printing area 140 is provided with maintenance portions 141, 142. The maintenance portions 141, 142 are positioned below the travel paths of the head units 100, 200, respectively. The maintenance operations on the head units 100, 200 are performed in the maintenance portions 141, 142 under the control of a CPU 40 (refer to FIG. 6) of the printer 1. The configurations and operations of the maintenance portions 141, 142 are the same. Accordingly, in the explanation that follows, the maintenance portion 141 will be explained.

As shown in FIGS. 2 and 3, the maintenance portion 141 is provided with the wiper 31, the flushing receiving portion 145, the absorption member 51, a support plate 149, the cap 67, and a cap support portion 69. As shown in FIG. 3, the flushing receiving portion 145 is positioned in the right part of the maintenance portion 141 and above a wall portion 74 of a moving portion 63 that will be described later. The flushing receiving portion 145 is provided with a container portion 146 and an absorbent member 147. The container portion 146 is a container that is rectangular in a plan view and is open at the top. The absorbent member 147 is provided inside the container portion 146 and is a three-dimensional rectangular member that is able to absorb the ink 91. The flushing receiving portion 145 receives the ink 91 that has been discharged from the head unit 100 by the flushing operation. The ink 91 is absorbed by the absorbent member 147.

As shown in FIGS. 2 and 3, the wiper 31 is provided to the left of the flushing receiving portion 145. The wiper 31 is able to move up and down. As shown in FIG. 3, the wiper 31 is provided below the nozzle face 111. The wiper 31 extends in the front-rear direction. The top edge of the wiper 31 is parallel to the nozzle face 111. A wiper support portion 32 is provided on the bottom side of the wiper 31 and supports the wiper 31. The wiper support portion 32 has a rectangular shape, with its long axis extending in the front-rear direction, and the wiper support portion 32 has a specified width in the left-right direction. The bottom portion of the wiper support portion 32 is able to move in relation to inclined portions 641, 642 (described later), which are provided on the moving portion 63, and comes into contact with the inclined portions 641, 642. The wiper support portion 32 is energized downward by a coil spring 60 that is affixed to the bottom portion of the wiper support portion 32.

As shown in FIGS. 2 and 3, the moving portion 63 is provided with opposing wall portions 651, 652 and the wall portion 74 (refer to FIG. 3). The pair of the opposing wall portions 651, 652 face one another in the front-rear direction and are substantially triangular in a side view. The opposing wall portions 651, 652 are respectively provided with the inclined portions 641, 642.

The pair of the inclined portions 641, 642 face one another in the front-rear direction. The pair of the inclined portions 641, 642 are formed on the upper parts of the opposing wall portions 651, 652, respectively, and are components that extend obliquely downward toward the left. As shown in FIG. 3, the wall portion 74 is a wall portion that is rectangular in a plan view, and it is connected to the lower parts of the right edges of the opposing wall portions 651, 652, respectively. The wall portion 74 is connected to a second drive portion 195 that will be described later (refer to FIG. 6). The moving portion 63 is moved to the left and the right by the second drive portion 195. The wiper support portion 32 moves up and down along the inclined portions 641, 642 in conjunction with the movements of the moving portion 63 to the right and the left, respectively.

An up-down position of the wiper 31 and the wiper support portion 32 in which the wiper 31 is separated from the nozzle face 111 and the absorption member 51, as shown in FIG. 3, will be called the wiper withdrawn position. In the wiper withdrawn position, the wiper support portion 32 is in contact with the lower ends of the inclined portions 641, 642.

Figure 4:
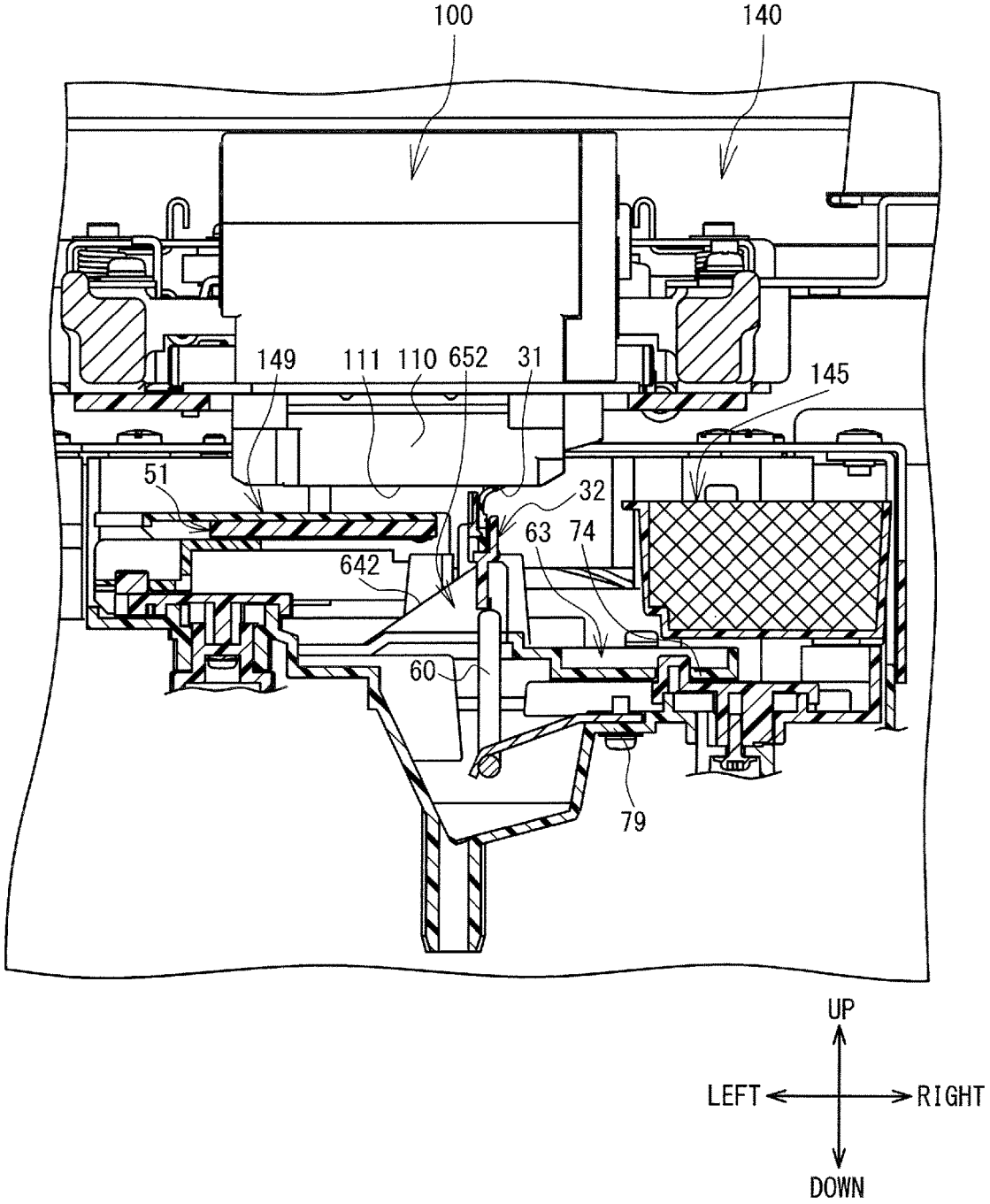
FIG. 4 is a section view that shows a state in which the wiper is in a first contact position and a nozzle face wiping operation is being performed.

An up-down position of the wiper 31 and the wiper support portion 32 in which the wiper 31 can be in contact with the nozzle face 111, as shown in FIG. 4, will be called the first contact position. In the first contact position, the wiper support portion 32 is in contact with the upper ends of the inclined portions 641, 642. In a state in which the wiper 31 and the wiper support portion 32 are in the first contact position, the moving of the carriage 20 to the right causes the wiper 31 to slide along the nozzle face 111. In that case, the wiper 31 removes the ink 91 and the cleaning liquid 92 from the nozzle face 111. In other words, the nozzle face wiping operation is performed.

Figure 5:
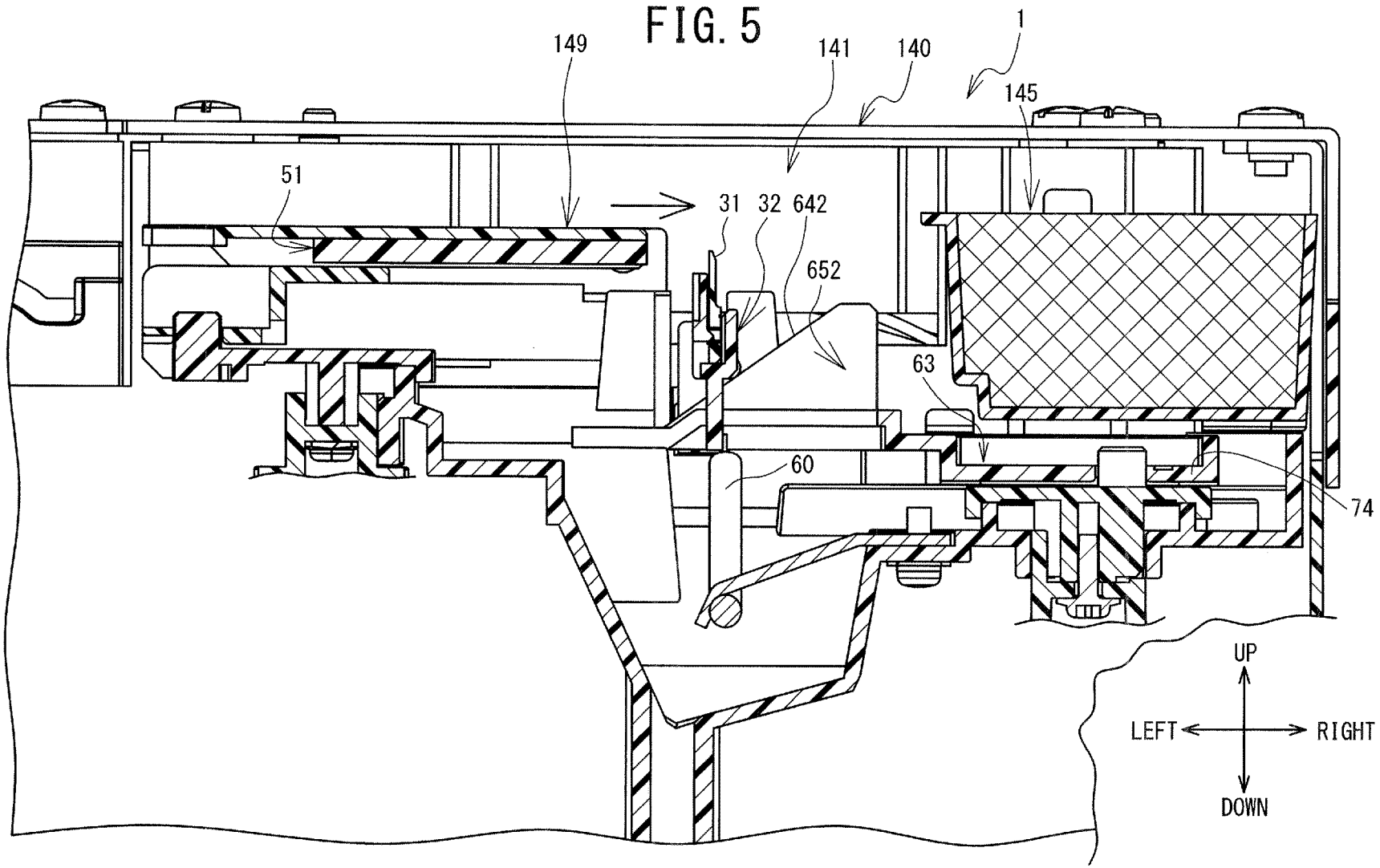
FIG. 5 is a section view that shows a state in which the wiper is in a second contact position.

An up-down position of the wiper 31 and the wiper support portion 32 in which the wiper 31 can be in contact with the absorption member 51, as shown in FIG. 5, will be called the second contact position. In the second contact position, the wiper support portion 32 is in contact with the inclined portions 641, 642 slightly below their centers in the up-down direction.

The support plate 149 is provided between the wiper 31 and the cap 67 in the left-right direction. The support plate 149 is a plate-shaped member that is rectangular in a plan view and that extends in the front-rear direction and the left-right direction. As shown in FIG. 3, the absorption member 51 is affixed to the bottom face of the support plate 149 and is supported by the support plate 149. The absorption member 51 is plate-shaped member that extends in the front-rear direction and the left-right direction. The absorption member 51 is able to absorb the ink 91 and the cleaning liquid 92.

Figure 6:
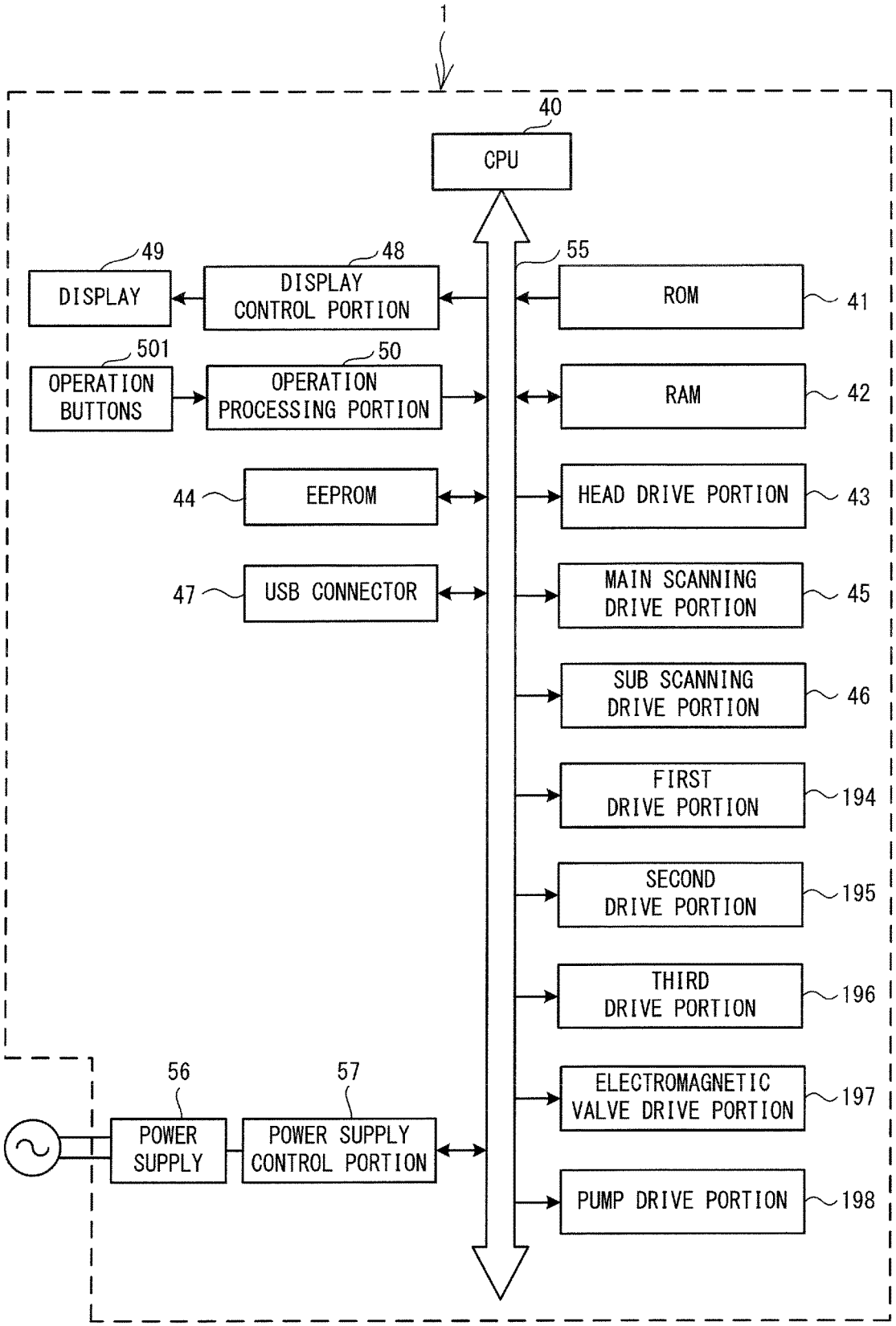
FIG. 6 is a block diagram that shows an electrical configuration of the printer.

The support plate 149 is moved to the left and the right by a first drive portion 194 (refer to FIG. 6).

In a state in which the wiper 31 and the wiper support portion 32 are in the second contact position, the moving of the support plate 149 to the right causes the wiper 31 to slide along the absorption member 51. In that case, the absorption member 51 absorbs and removes the ink 91 and the cleaning liquid 92 that have adhered to the wiper 31. In other words, the wiper wiping operation is performed.

As shown in FIGS. 2 and 3, the cap 67 and the cap support portion 69 are provided in the left portion of the maintenance portion 141. The cap 67 is included in a maintenance flow path system 700 that will be described later (refer to FIG. 7). The cap support portion 69 has a box shape that is rectangular in a plan view, and its top face is open. The cap 67 is provided on the inner side of the cap support portion 69.

The cap 67 is formed from a synthetic resin such as rubber or the like, for example. A perimeter wall 672 that configures the cap 67 extends upward from the perimeter of a bottom wall 671 that configures the cap 67. The perimeter wall 672 faces the perimeter of the nozzle disposition area 120 of the nozzle face 111 from below.

A partition wall 673 that configures the cap 67 extends upward from the bottom wall 671 and is connected to the front edge and the rear edge of the perimeter wall 672. Therefore, the partition wall 673 divides the area inside the perimeter wall 672 into two parts. In the explanation that follows, the area inside the perimeter wall 672 that is to the left of the partition wall 673 will be called the first area 661, and the area that is to the right of the partition wall 673 will be called the second area 662. The partition wall 673 faces a boundary 127 between the nozzle array 121 and the nozzle arrays 122 to 124 from below. A portion of a cap lip 676, which is formed on the upper edges of the perimeter wall 672, is at the same height as a portion of the cap lip 676, which is formed on the partition wall 673.

Figure 11:
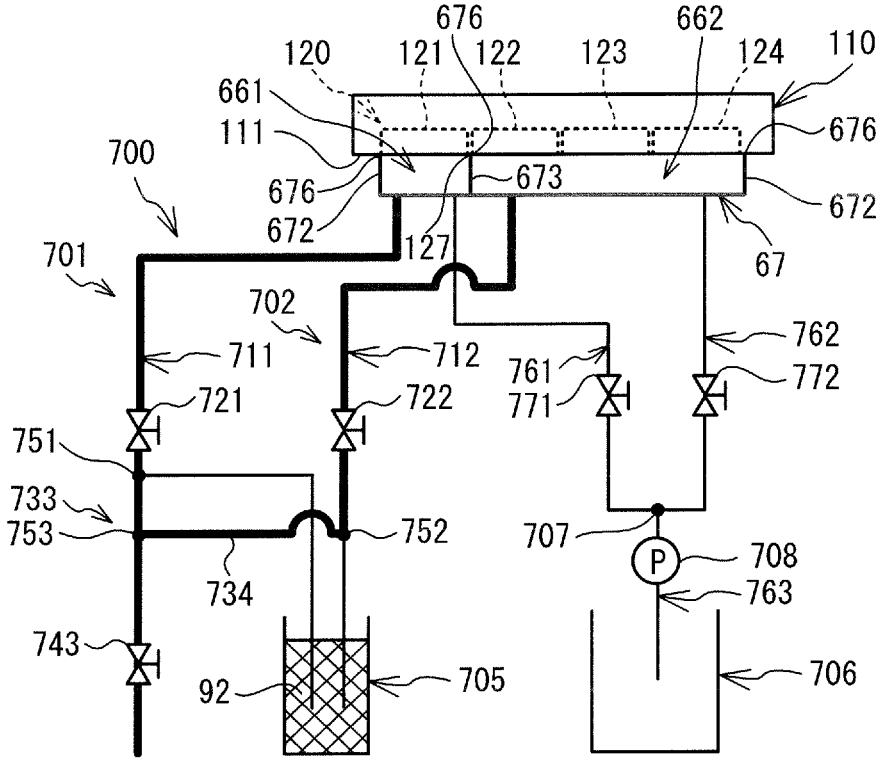
FIG. 11 is a schematic drawing of the maintenance flow path system that shows a state in which the cap has moved to the covering position.

The cap support portion 69 is moved up and down between a covering position (refer to FIGS. 3 and 11) and a cap withdrawn position (refer to FIG. 7) by the operation of a third drive portion 196 (refer to FIG. 6) that will be described later. The covering position is a position where the cap 67 is tightly affixed to the nozzle face 111, such that the cap 67 and the cap support portion 69 cover the nozzles 112. The cap withdrawn position is a position where the cap 67 has withdrawn downward from the nozzle face 111. As shown in FIGS. 3 and 11, in a case where the cap 67 and the cap support portion 69 are in the covering position, the cap lip 676 is tightly affixed to the perimeter of the nozzle disposition area 120 of the nozzle face 111 in the head unit 100, which has moved to the non-printing area 140. The plurality of the nozzles 112 are thus covered (refer to FIG. 12). The upper edge of the partition wall 673, which configures the cap lip 676, is also tightly affixed to the boundary 127 of the nozzle face 111. The ink purge operation and the cleaning operation are performed while the cap 67 and the cap support portion 69 are in the covering position.

Electrical Configuration of the Printer 1

As shown in FIG. 6, the printer 1 is provided with the CPU 40, which controls the printer 1. Through a bus 55, the CPU 40 is electrically connected to a ROM 41, a RAM 42, a head drive portion 43, a main scanning direction drive portion 45, the sub scanning direction drive portion 46, the first drive portion 194, the second drive portion 195, the third drive portion 196, an electromagnetic valve drive portion 197, a pump drive portion 198, a display control portion 48, an operation processing portion 50, an EEPROM 44, a USB connector 47, and a power supply control portion 57. The power supply 56 is connected to the power supply control portion 57.

The ROM 41 stores a control program by which the CPU 40 controls the printer 1, as well as initial values and the like. The RAM 42 temporarily stores various types of data that are used by the control program. The EEPROM 44 stores a soaking flag that indicates that soaking processing, which will be described later, has been performed, a printing-in-progress flag that indicates that printing is in progress, a page count of the pages printed since the most recent ink purge operation, the time when printing processing was most recently performed, the time when the most recent ink purge operation was performed, the time when the most recent soaking processing was performed, and the like. When the CPU 40 performs the soaking processing, the CPU 40 stores the soaking flag and the time in the EEPROM 44 (Step S24 in FIG. 10), and when the CPU 40 performs de-wetting processing, which will be described later, the CPU 40 deletes the soaking flag that is stored in the EEPROM 44 (Step S59 in FIG. 15). The head drive portion 43 is electrically connected to the heads 110 that discharge the inks 91. By operating piezoelectric elements that are provided in individual discharge channels in the heads 110 (refer to FIG. 3), the head drive portion 43 causes the inks 91 to be discharged from the nozzles 112 (refer to FIG. 12).

The main scanning direction drive portion 45 includes the drive motor 19 (refer to FIG. 1) and moves the carriage 20 in the left-right direction (the main scanning direction). The sub scanning direction drive portion 46 includes a motor, a gear, and the like that are not shown in the drawings. By operating the platen drive mechanism 6 (refer to FIG. 1), the sub scanning direction drive portion 46 moves the platen 5 (refer to FIG. 1) in the front-rear direction (the sub scanning direction).

The first drive portion 194 includes a first drive motor (not shown in the drawings), a gear (not shown in the drawings), and the like. By moving the support plate 149 to the left and the right, the first drive portion 194 moves the absorption member 51 to the left and the right. The second drive portion 195 includes a second drive motor (not shown in the drawings), a gear (not shown in the drawings), the moving portion 63 (refer to FIG. 3), and the like. By moving the wiper support portion 32 up and down, the second drive portion 195 moves the wiper 31 up and down. The third drive portion 196 includes a third drive motor (not shown in the drawings), a gear (not shown in the drawings), and the like. By moving the cap support portion 69 up and down, the third drive portion 196 moves the cap 67 up and down.

The electromagnetic valve drive portion 197 opens and closes supply on-off valves 721, 722, an air on-off valve 743, and waste liquid on-off valves 771, 772, all of which will be described later (refer to FIG. 7). The pump drive portion 198 operates the suction pump 708, which will be described later (refer to FIG. 7). The display control portion 48 controls displays on the display 49. The operation processing portion 50 takes operational inputs to the operation buttons 501 and outputs the operational inputs to the CPU 40. A USB cable from a computer (not shown in the drawings) is connected to the USB connector 47, and commands and printing data are input from the computer. The power supply 56 is an AC/DC adaptor, and the power supply 56 supplies direct current electric power to the CPU 40, the individual drive portions, and the like (hereinafter described as supplying electric power to the printer 1). The power supply control portion 57 controls the turning on and off of the supply of the electric power from the power supply 56 according to commands from the CPU 40. Even when the electric power has been turned off, weak electric power is supplied to the CPU 40 and the operation processing portion 50, such that the CPU 40 is able to detect a command from the operation buttons 501 to turn on the electric power.

Structure of the Maintenance Flow Path System 700

Figure 7:
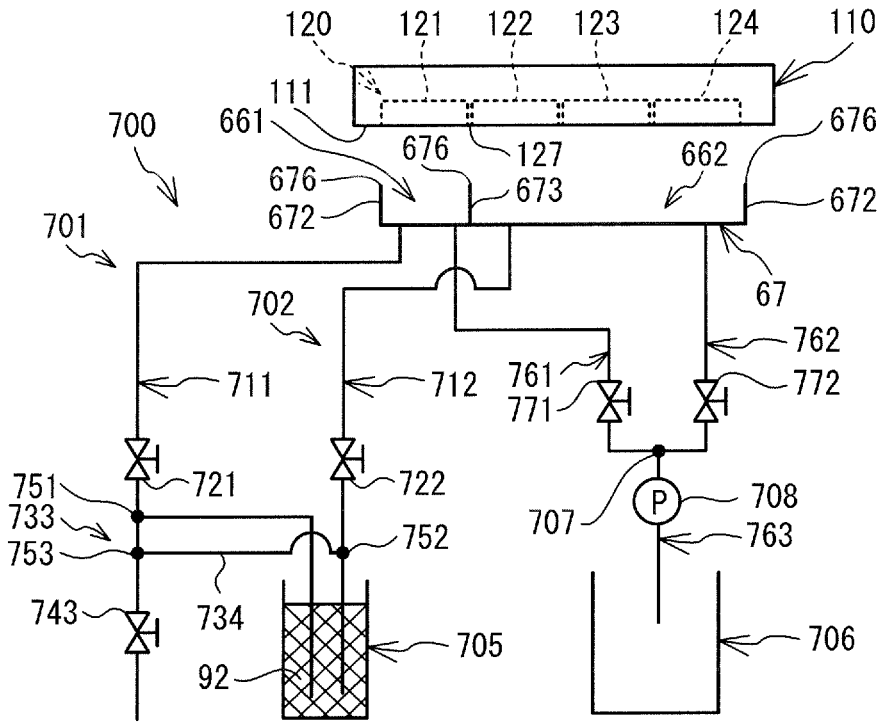
FIG. 7 is a schematic drawing of a maintenance flow path system in a state in which the cap is in a cap withdrawn position.

As shown in FIG. 7, the printer 1 is provided with the maintenance flow path system 700. To make the drawing easier to understand, the maintenance flow path system 700 and the head 110 are shown schematically in FIG. 7. The maintenance flow path system 700 is a mechanism through which the inks 91, the cleaning liquid 92, and air flow when maintenance processing that will be described later (refer to FIG. 10) and de-wetting processing (refer to the FIG. 15) are performed. The maintenance flow path system 700 is provided with a cleaning liquid tank 705, supply flow paths 711, 712, the supply on-off valves 721, 722, a gas flow path 733, a connecting path 734, the air on-off valve 743, waste liquid flow paths 761, 762, 763, the waste liquid on-off valves 771, 772, the suction pump 708, and a waste liquid tank 706.

The cleaning liquid tank 705 is a container that stores the cleaning liquid 92. The supply flow path 711 is a flow path that is connected to the cleaning liquid tank 705 and to the first area 661 in the cap 67. The operating of the suction pump 708 makes it possible for the supply flow path 711 to take the cleaning liquid 92 that is stored in the cleaning liquid tank 705 and supply the cleaning liquid 92 to the first area 661 in the cap 67. The supply flow path 712 is a flow path that is connected to the cleaning liquid tank 705 and to the second area 662 in the cap 67. In the same manner as the supply flow path 711, the supply flow path 712 is able to supply the cleaning liquid 92 to the second area 662 in the cap 67.

The supply on-off valves 721, 722 are electromagnetic valves that are provided in the supply flow paths 711, 712 and that open and close the supply flow paths 711, 712. The gas flow path 733 is connected to the supply flow path 711 at a convergence portion 751 that is located between the supply on-off valve 721 and the cleaning liquid tank 705. Therefore, the gas flow path 733 is connected to the first area 661 of the cap 67 through the supply flow path 711. The opposite end of the gas flow path 733 from the convergence portion 751 is open to the atmosphere. Therefore, the gas flow path 733 is a flow path through which air can pass. The air on-off valve 743 is an electromagnetic valve that is provided in the gas flow path 733, and the air on-off valve 743 opens and closes the gas flow path 733. The gas flow path 733 is also connected to the supply flow path 712 by the connecting path 734. One end of the connecting path 734 is connected to a convergence portion 753 between the convergence portion 751 and the air on-off valve 743. The other end of the connecting path 734 is connected to the supply flow path 712 at a convergence portion 752 that is located between the supply on-off valve 722 and the cleaning liquid tank 705. Therefore, the gas flow path 733 is connected to the second area 662 of the cap 67 through the connecting path 734 and the supply flow path 712.

Note that the gas flow path 733 may also be connected directly to the cap 67, without being connected to the supply flow paths 711, 712. In that case, the single gas flow path 733 may be divided into two branches, with one branch being connected to the first area 661 and the other branch being connected to the second area 662. The gas flow path 733 may also be provided in the form of two gas flow paths, with one of the gas flow paths 733 being connected to the first area 661 and the other of the gas flow paths 733 being connected to the second area 662. The convergence portion 752 may also be located between the cap 67 and the supply on-off valve 722 in the supply flow path 712, and the convergence portion 753 may also be located between the cap 67 and the supply on-off valve 721 in the supply flow path 711. In that case, the gas flow path 733, which is connected to the convergence portions 752, 753, may be provided as a single gas flow path, and the gas flow path 733 may also be provided in the form of two gas flow paths.

The waste liquid flow path 761 is connected to the first area 661 of the cap 67. The waste liquid flow path 762 is connected to the second area 662 of the cap 67. The waste liquid flow paths 761, 762 converge at a convergence portion 707 to form the single waste liquid flow path 763. The waste liquid flow path 763 is connected to the waste liquid tank 706. The waste liquid tank 706 is a container that stores the inks 91 and the cleaning liquid 92 that have been drained out of the cap 67. The suction pump 708 is provided in the waste liquid flow path 763. The operation of the suction pump 708 enables the waste liquid flow paths 761, 762, 763 to drain the inks 91 and the cleaning liquid 92 out of the cap 67. The waste liquid on-off valves 771, 772 are electromagnetic valves that are provided in the waste liquid flow paths 761, 762 and that open and close the waste liquid flow paths 761, 762.

In the explanation that follows, the supply flow path 711, the gas flow path 733, and the waste liquid flow paths 761, 763, all of which are connected to the first area 661, will be called a first flow path system 701. The supply flow path 712, the gas flow path 733, the connecting path 734, and the waste liquid flow paths 762, 763, all of which are connected to the second area 662, will be called a second flow path system 702.

Power on Time Processing

Figure 8:
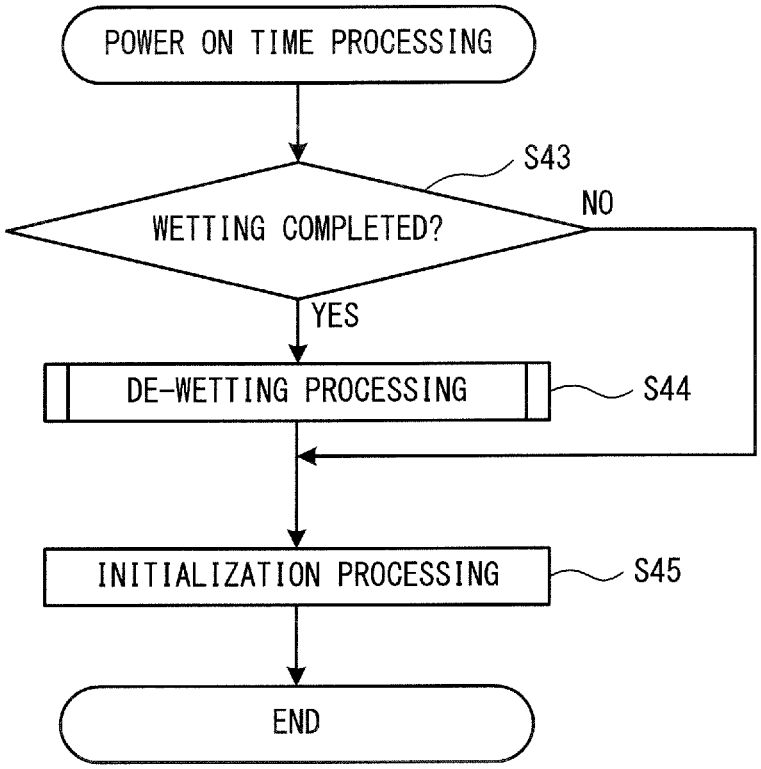
FIG. 8 is a flowchart of power on time processing.

When the power supply 56 to the printer 1 is turned on, the CPU 40 performs power on time processing, which is shown in FIG. 8. When the CPU 40 detects a power on signal that is based on a power on operation of the operation buttons 501, the power supply 56 supplies the electric power to the printer 1, and the CPU 40 reads the control program that is stored in the ROM 41 and controls the printer 1. First, the CPU 40 determines whether soaking has been completed (Step S43). Soaking will be described in detail later. In a case where soaking has been completed, for example, the soaking flag is stored in the EEPROM 44 (refer to Step S24 in FIG. 10). Accordingly, in a case where the soaking flag is stored in the EEPROM 44 (YES at Step S43), the CPU 40 performs the de-wetting processing (Step S44). The de-wetting processing will be described in detail later. After the de-wetting processing (Step S44), the CPU 40 performs initialization processing (Step S45). For example, the CPU 40 performs processing that clears storage areas in the RAM 42 (Step S45). In a case where the CPU 40 does not determine that the soaking flag is stored in the EEPROM 44 (NO at Step S43), the CPU 40 performs the initialization processing (Step S45) without performing the de-wetting processing (Step S44). After the initialization processing (Step S45), the CPU 40 terminates the power on time processing. The printer 1 enters a standby state.

Note that after Step S44, the CPU 40 may also move the cap 67 from the covering position to the cap withdrawn position (refer to FIG. 7), then perform wiping processing, which performs the nozzle face wiping operation. In the wiping processing, the CPU 40 operates the second drive portion 195 (refer to FIG. 6) to move the wiper 31 and the wiper support portion 32 from the wiper withdrawn position (refer to FIG. 3) to the first contact position, as shown in FIG. 4. The CPU 40 operates the main scanning direction drive portion 45 (refer to FIG. 6) to move the carriage 20 toward the right. The wiper 31 thus slides along the nozzle face 111 and wipes off the cleaning liquid 92 and the ink 91 that are remaining on the surface of the nozzle face 111. Next, the CPU 40 may also perform the wiper wiping operation. In the wiper wiping operation, the CPU 40 operates the second drive portion 195 to move the wiper 31 and the wiper support portion 32 from the first contact position (refer to FIG. 4) to the second contact position. The CPU 40 operates the first drive portion 194 to move the absorption member 51 toward the right. The wiper 31 thus slides along the bottom face of the absorption member 51, and the cleaning liquid 92 and the ink 91 that are adhering to the wiper 31 are wiped off. The CPU 40 operates the second drive portion 195 to move the wiper 31 from the second contact position to the wiper withdrawn position (refer to FIG. 3). The CPU 40 operates the first drive portion 194 (refer to FIG. 6) to move the support plate 149 and the absorption member 51, which have moved to the right, toward the left. The CPU 40 operates the main scanning direction drive portion 45 to move the carriage 20 toward the left and position the nozzle face 111 above the cap 67. Next, the CPU 40 advances to the initialization processing (Step S45).

Cycle Processing

Figure 9:
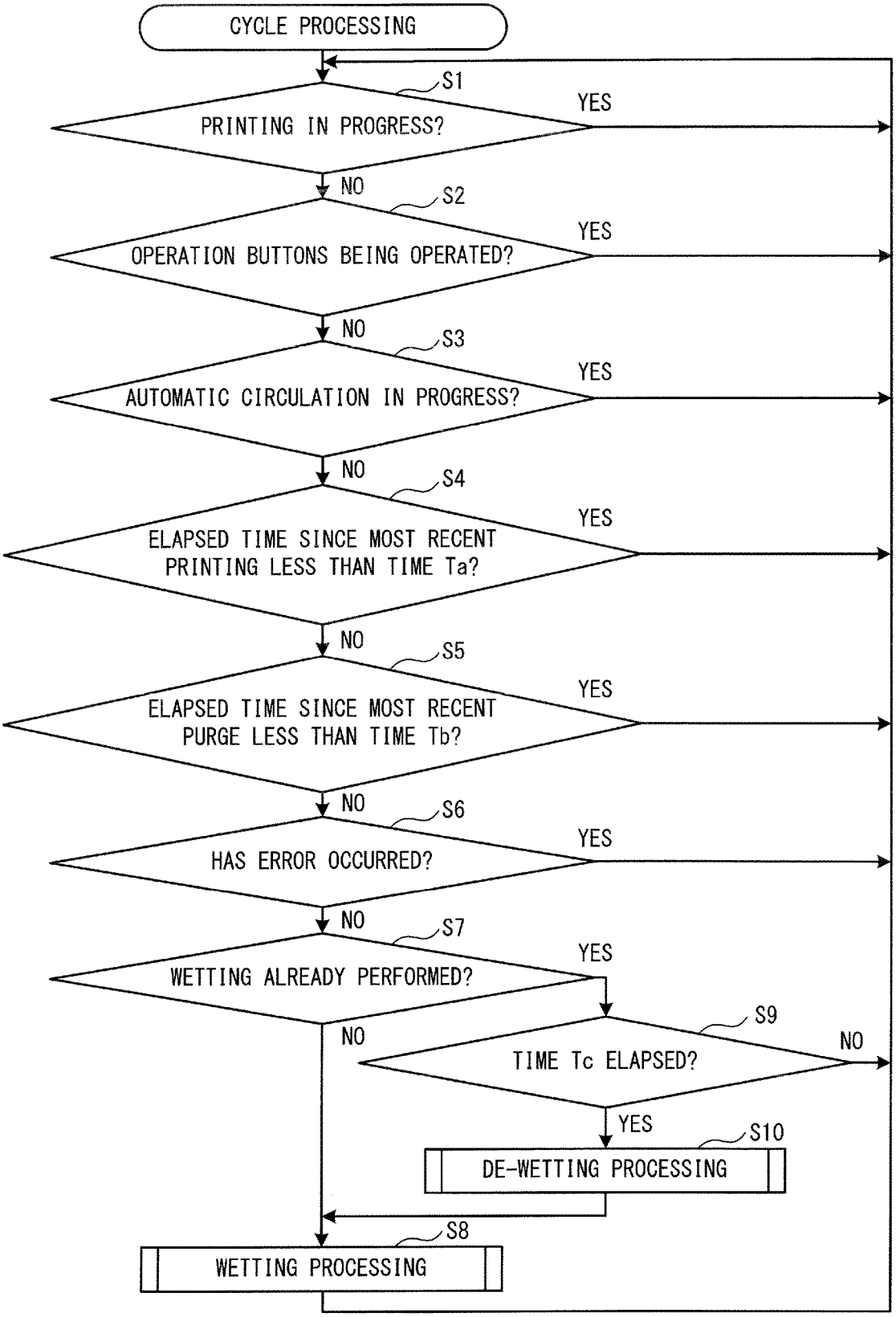
FIG. 9 is a flowchart of cycle processing.

In the printer 1, after the power on time processing, the CPU 40 performs cycle processing, which is shown in FIG. 9. In the cycle processing, the CPU 40 first determines whether printing is in progress (Step S1). For example, in a case where the printing-in-progress flag is stored in the EEPROM 44, the CPU 40 determines that printing is in progress (YES at Step S1). In a case where the CPU 40 has determined that printing is in progress (YES at Step S1), the heads 110 are in the process of discharging the inks 91. Therefore, the soaking processing (Step S8) and the de-wetting processing (Step S10) cannot be performed, so the CPU 40 returns the processing to Step S1. In a case where the CPU 40 does not determine that printing is in progress (NO at Step S1), the CPU 40 determines whether the operation buttons 501 are being operated (Step S2). For example, in a case where the operation buttons 501 are being operated by the operator, such that a command from the operation processing portion 50 is being output to the CPU 40, the CPU 40 determines that the operation buttons 501 are being operated (YES at Step S2) and returns the processing to Step S1.

In a case where the CPU 40 does not determine that the operation buttons 501 are being operated (NO at Step S2), the CPU 40 determines whether automatic circulation is in progress (Step S3). Automatic circulation is processing in which a circulation pump (not shown in the drawings) circulates the ink 91 at a specified time intervals through each one of an ink supply flow path (not shown in the drawings) and a circulation flow path (not shown in the drawings). The ink supply flow path is connected to the head 110 and the cartridge (not shown in the drawings) and supplies the ink 91 to the head 110 from the cartridge. One end of the circulation flow path (not shown in the drawings) is connected to the cartridge or the upstream side of the ink supply flow path, and the other end of the circulation flow path is connected to the head 110 or the downstream side of the ink supply flow path. Automatic circulation agitates the white ink, which is prone to sedimentation, thereby eliminating the sedimentation. The specified time may be one hour, for example. In a case where the CPU 40 has determined that automatic circulation is in progress (YES at Step S3), the ink 91 circulates through the circulation flow path. Therefore, the soaking processing (Step S8) and the de-wetting processing (Step S10) cannot be performed, so the CPU 40 returns the processing to Step S1.

In a case where the CPU 40 does not determine that automatic circulation is in progress (NO at Step S3), the CPU 40 determines whether the elapsed time since the most recent printing is less than a time Ta (Step S4). The time of the most recent printing is stored in the EEPROM 44 (refer to Step S71 in FIG. 17). In a case where the CPU 40 has determined that the elapsed time since the most recent printing is less than the time Ta (YES at Step S4), the CPU 40 returns the processing to Step S1. The time Ta may be eight hours for example. The reason for setting the time Ta to eight hours is that, if the elapsed time is less than eight hours, the possibility is low that the nozzles 112 will become clogged by the drying of the ink 91 inside the nozzles 112, thus causing discharge failures. In a case where the CPU 40 does not determine that the elapsed time since the most recent printing is less than the time Ta, that is, where the CPU 40 has determined that the time Ta has elapsed (NO at Step S4), the CPU 40 determines whether the elapsed time since the most recent ink purge operation is less than a time Tb (Step S5). The time of the most recent ink purge operation is stored in the EEPROM 44 (refer to Step S69 in FIG. 17). In a case where the CPU 40 has determined that the elapsed time since the most recent ink purge operation is less than the time Tb (YES at Step S5), the CPU 40 returns the processing to Step S1. The time Tb may be eight hours for example. The reason for setting the time Tb to eight hours is that, if the elapsed time is less than eight hours, the possibility is low that the nozzles 112 will become clogged by the drying of the ink 91 inside the nozzles 112, thus causing discharge failures. Note that in the explanation above, the time Ta and the time Tb be are equal, but the time Tb may also be greater than the time Ta, and the time Tb may also be less than the time Ta. Hereinafter, the processing at Steps S4 and S5 will sometimes be called the second determination processing.

In a case where the CPU 40 does not determine that the elapsed time since the most recent ink purge operation is less than the time Tb, that is, where the CPU 40 has determined that the time Tb has elapsed (NO at Step S5), the CPU 40 determines whether an error has occurred (Step S6). For example, an error may be a shortage of the cleaning liquid 92 in the cleaning liquid tank 705, a failure of the suction pump 708, a failure of the supply on-off valves 721, 722, a failure of the air on-off valve 743, a failure of the waste liquid on-off valves 771, 772, or the like. A shortage of the cleaning liquid 92 is detected by a sensor (not shown in the drawings) that detects the amount of the cleaning liquid 92 that is stored in the cleaning liquid tank 705. A failure of the suction pump 708 is detected by the pump drive portion 198. A failure of the electromagnetic valves is detected by the electromagnetic valve drive portion 197. The various detection signals make it possible for the CPU 40 to determine that an error has occurred. In a case where the CPU 40 has determined that an error has occurred (YES at Step S6), the CPU 40 returns the processing to Step S1.

In a case where the CPU 40 does not determine that an error has occurred (NO at Step S6), the CPU 40 determines whether soaking has already been performed (Step S7). The soaking flag, which indicates that soaking has already been performed, is stored in the EEPROM 44 (refer to Step S24 in FIG. 10). In a case where the soaking flag has not been stored in the EEPROM 44, the CPU 40 does not determine that soaking has already been performed (NO at Step S7) and performs the soaking processing (Step S8), which will be described later. In a case where the soaking flag is stored in the EEPROM 44, the CPU 40 determines that soaking has already been performed (YES at Step S7). The CPU 40 then determines whether the elapsed time since the most recent soaking processing is not less than a time Tc (Step S9). The time of the most recent soaking processing is stored in the EEPROM 44 (refer to Step S24 in FIG. 10). Note that the time Tc may be greater than the time Ta and the time Tb. The time Tc may be ten hours, for example. In a case where the CPU 40 has determined that the elapsed time since the most recent soaking processing is not less than the time Tc (YES at Step S9), the CPU 40 performs the de-wetting processing (Step S10). In a case where the CPU 40 does not determine that the elapsed time since the most recent soaking processing is not less than the time Tc (NO at Step S9), the CPU 40 returns the processing to Step S1.

Note that after Step S10, the CPU 40 may move the cap 67 from the covering position to the cap withdrawn position (refer to FIG. 7) and perform the wiping processing. The CPU 40 may also perform the wiper wiping operation after the wiping processing.

Soaking Processing

Figure 10:
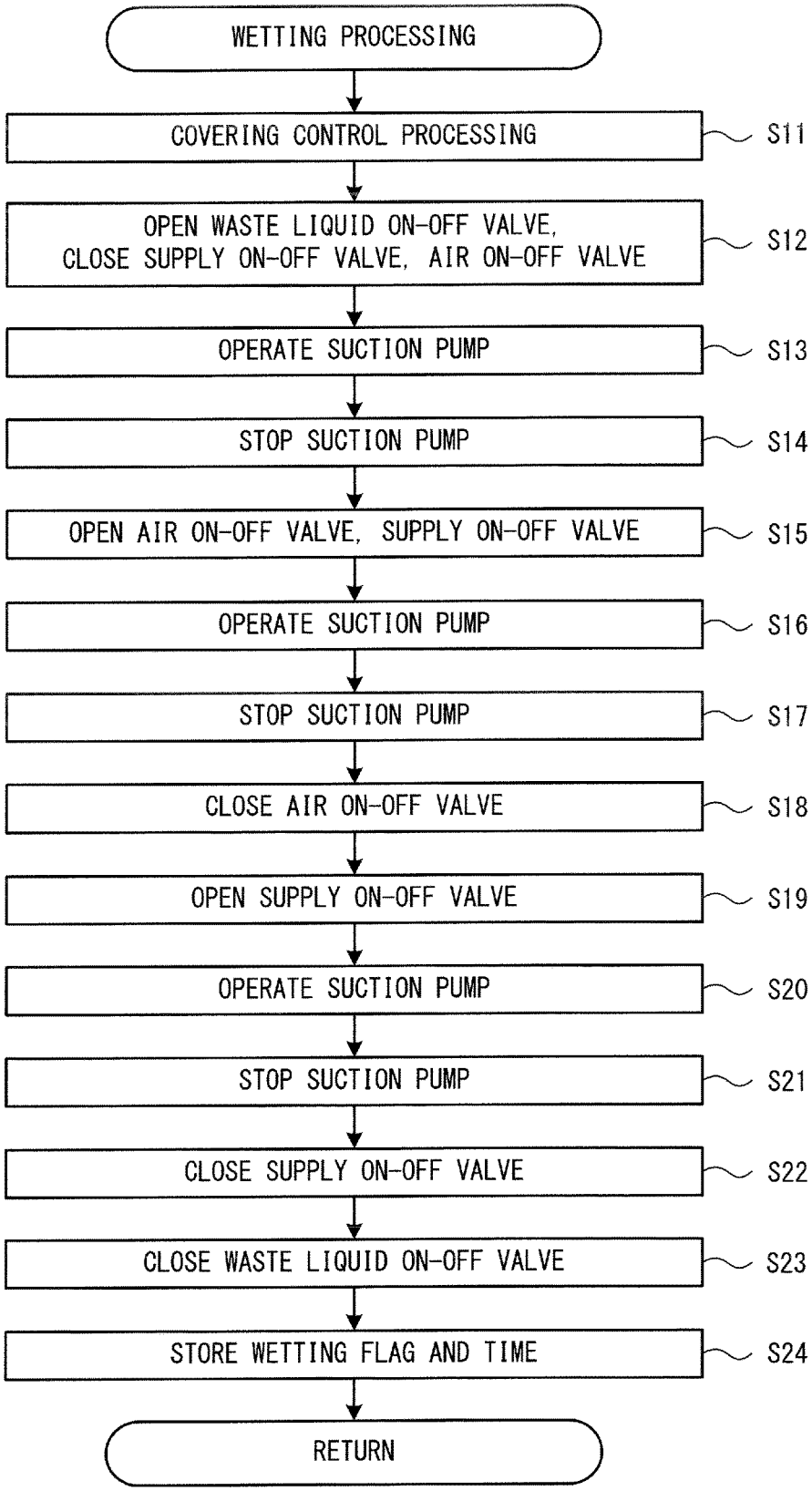
FIG. 10 is a flowchart of a subroutine of soaking processing.

The CPU 40 performs the soaking processing (Step S8) according to the subroutine that is shown in FIG. 10. In a case where the cap 67 is in the cap withdrawn position before the soaking processing is performed, as shown in FIG. 7, the CPU 40 starts the soaking processing by performing covering control processing (Step S11). The covering control processing operates the third drive portion 196 (refer to FIG. 6) to move the cap support portion 69 upward, thus moving the cap 67 from the cap withdrawn position (refer to FIG. 7) to the covering position (refer to FIGS. 3 and 11). The cap 67 thus enters a covering state in which it covers the nozzle face 111 (Step S11). Note that if either the air on-off valve 743 is closed or the supply on-off valves 721, 722 are closed when Step S11 is performed, there is a possibility that the air in the interior of the first area 661 and the second area 662 will be compressed when the cap 67 is pressed against the nozzle face 111. That would create a repulsive force that would make it difficult for the cap lip 676 of the cap 67 to be affixed tightly to the nozzle face 111. Therefore, when the CPU 40 will perform Step S11, that is, before the cap lip 676 is affixed tightly to the nozzle face 111, the CPU 40 opens the first area 661 and the second area 662 to the atmosphere by opening the air on-off valve 743 and the supply on-off valves 721, 722, as shown in FIG. 11. The air inside the first area 661 and the second area 662 thus easily escapes to the outside through the gas flow path 733, such that the cap lip 676 is smoothly affixed tightly to the nozzle face 111. Note that the air on-off valve 743 may also be left closed.

In FIGS. 11 to 14 and FIG. 16, the flow paths that are open based on the open/closed statuses of the individual electromagnetic valves are indicated by bolder lines than the other flow paths. As shown in FIG. 11, in the covering state, the nozzle array 121 is provided inside the first area 661, and the nozzle arrays 122 to 124 are provided inside the second area 662.

Next, the CPU 40 performs the processing at Steps S12 to S24. At Steps S12 to S24, the first flow path system 701 is used in the performing of the ink purge operation, the cleaning operation and the like on the first area 661. The cleaning operation cleans the nozzle face 111 by soaking the nozzle face 111 with the cleaning liquid 92. While the CPU 40 is performing Steps S12 to S24, unless otherwise specified, it is preferable for the supply on-off valve 722 and the waste liquid on-off valve 772, which are the electromagnetic valves that are located in the second flow path system 702, to be closed. The air on-off valve 743 may be closed, and the air on-off valve 743 may also be open. Accordingly, in the following explanation of the processing at Steps S12 to S24, an explanation of the control of the electromagnetic valves that are located in the second flow path system 702 will be omitted.

Figure 12:
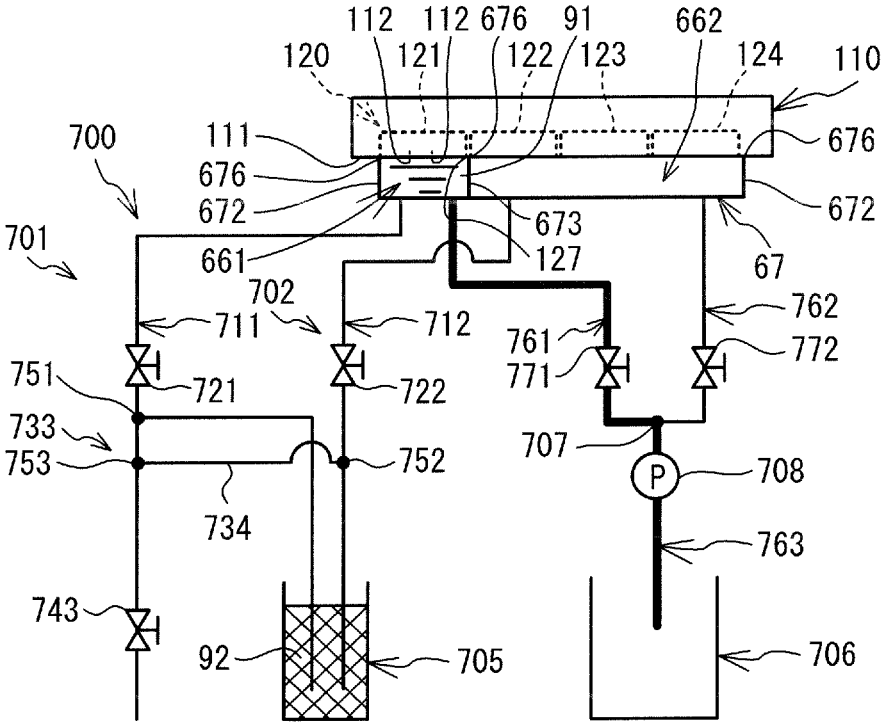
FIG. 12 is a schematic drawing of the maintenance flow path system that shows a state in which an ink has been drawn from a nozzle into a first area.

The CPU 40 performs a first purge (Steps S12 to S14), which draws the ink 91 inside the nozzles 112 of the nozzle array 121 into the first area 661 of the cap 67, as shown in FIG. 12. At Step S12, the CPU 40 controls the individual electromagnetic valves such that the cleaning liquid 92 from the supply flow path 711 and the air from the gas flow path 733 are not introduced into the first area 661. For example, the CPU 40 closes the supply on-off valve 721 and the air on-off valve 743 (Step S12), and opens the waste liquid on-off valve 771. Next, the CPU 40 operates the suction pump 708 at a second rotation speed for a specified length of time (Step S13). The second rotation speed may be 3000 rpm, for example, and the specified length of time may be 1 to 3 seconds, for example. Because the supply on-off valve 721 and the air on-off valve 743 are closed, a negative pressure is created inside the first area 661 by the suction force of the suction pump 708 inside the first area 661. The ink 91 inside the nozzles 112 of the nozzle array 121 is thus drawn into the first area 661. A portion of the ink 91 that is drawn out may also flow to the waste liquid tank 706 through the waste liquid flow paths 761, 763. The CPU 40 stops the suction pump 708 (Step S14). In other words, the operation of the suction pump 708 is stopped.

Figure 13:
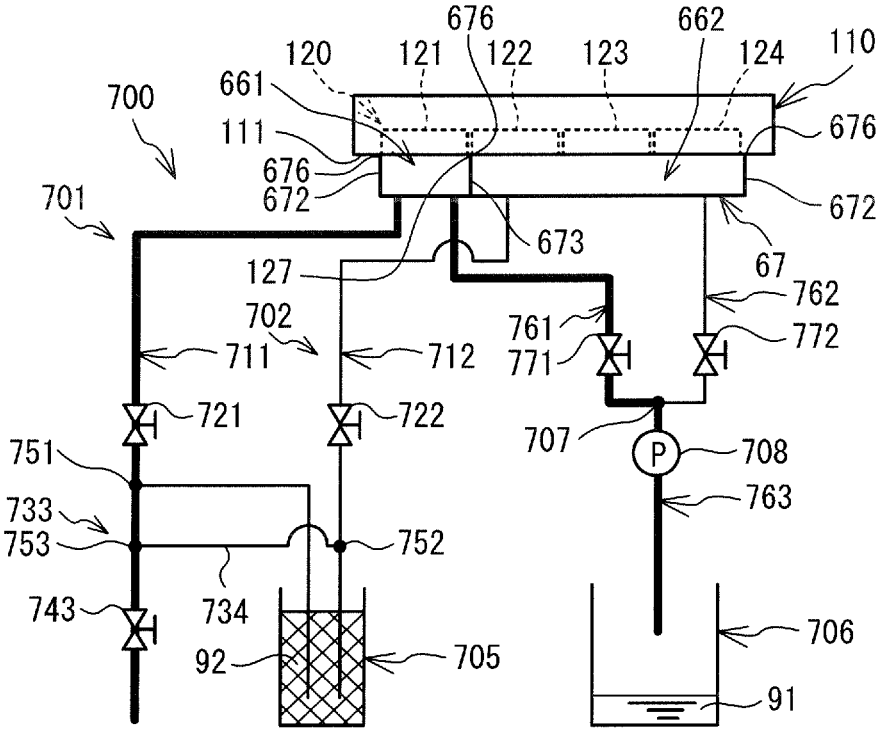
FIG. 13 is a schematic drawing of the maintenance flow path system that shows a state in which the ink has been drained from the first area.

Next, the CPU 40 performs a second purge (Steps S15 to S17), which takes the ink 91 that was drawn into the first area 661 from the nozzles 112 at Step S12 and drains out the ink 91 that was drawn into the first area 661 through the waste liquid flow paths 761, 763, such that none of the ink 91 remains in the first area 661. In the second purge, the CPU 40 controls the individual electromagnetic valves such that the air from the gas flow path 733 is introduced into the first area 661 without introducing the cleaning liquid 92 from the supply flow path 711 into the first area 661, as shown in FIG. 13. For example, while leaving the waste liquid on-off valve 771 open, the CPU 40 opens the supply on-off valve 721 and the air on-off valve 743 (Step S15). The CPU 40 operates the suction pump 708 at a third rotation speed for a specified length of time (Step S16). The third rotation speed may be 300 rpm, for example, and the specified length of time may be 30 seconds, for example. The suction force of the suction pump 708 causes air to flow into the first area 661 through the gas flow path 733 and causes the ink 91 inside the first area 661 to be drained into the waste liquid tank 706 through the waste liquid flow paths 761, 763. The CPU 40 stops the suction pump 708 (Step S17).

Figure 14:
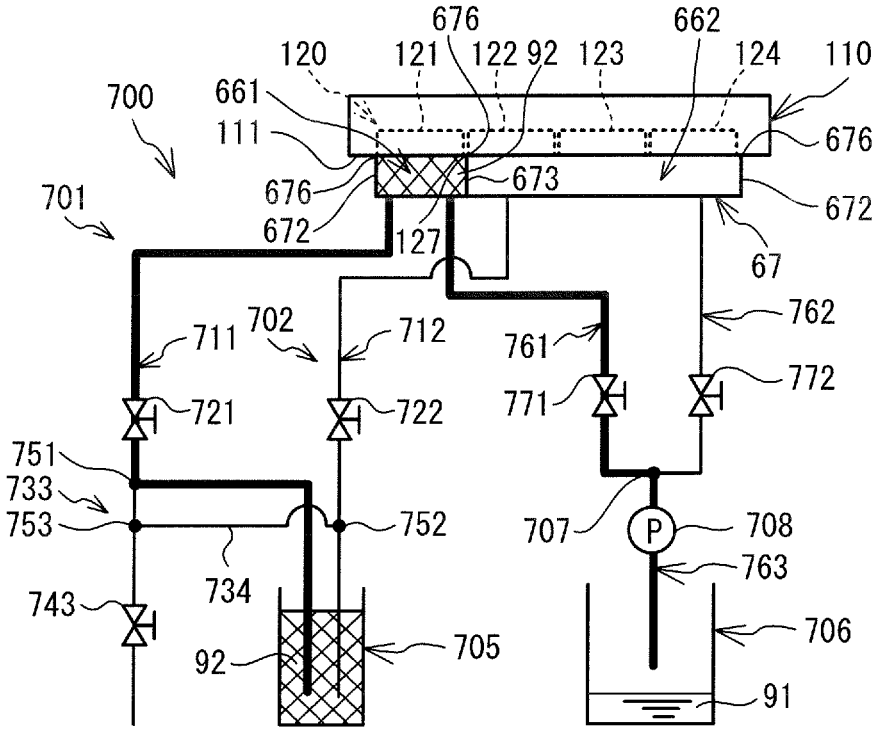
FIG. 14 is a schematic drawing of the maintenance flow path system that shows a state in which a cleaning liquid has been injected into the first area.

Next, the CPU 40 performs supply processing (Steps S18 to S20), which supplies the cleaning liquid 92 from the cleaning liquid tank 705 into the first area 661 of the cap 67 through the supply flow path 711. The CPU 40 starts the supply processing by operating the valves. For example, the CPU 40 closes the air on-off valve 743 (Step S18), then opens the supply on-off valve 721 (Step S19), as shown in FIG. 14. At this time, the waste liquid on-off valve 771 is open.

Next, the CPU 40 operates the suction pump 708 at a first rotation speed, which is slower than the second rotation speed at Step S13 (Step S20). The first rotation speed is not greater than 800/3000 of the second rotation speed, so the first rotation speed may be 300 rpm or 800 rpm, for example. Note that the first rotation speed may be greater than the third rotation speed at Step S16. In a case where the suction pump 708 is a tube pump, the CPU 40 may operate the pump at the first rotation speed for two rotations, for example, but it is not limited to two rotations and may also operate the pump for one rotation and for more than two rotations. When the suction pump 708 is operated at the first rotation speed, the cleaning liquid 92 is supplied from the cleaning liquid tank 705 to the first area 661 of the cap 67 through the supply flow path 711, and the cleaning liquid 92 soaks the nozzle face 111 (Step S20). The nozzle face 111 is thereby cleaned by the cleaning liquid 92. At the same time, because the cleaning liquid 92 destroys the meniscuses in the nozzles 112, the ink 91 is expelled from the nozzles 112 into the first area 661 as the cleaning liquid 92 makes its way into the nozzles 112.

Soaking

The inventor has confirmed that the cleaning liquid 92 soaks the nozzle face 111 in the injection processing under the following conditions:

(1) The second area 662 that is shown in FIG. 2 measures 22 millimeters from left to right and 39 millimeters from front to rear, and a distance L from the nozzle face 111 to the bottom face of the second area 662 is 1.1 millimeters. In other words, a surface area S of the second area 662 in a plan view is 858 square millimeters, and a volume V of the second area 662 is 943.8 cubic millimeters.

(2) The first rotation speed in the injection processing is 300 rpm.

(3) A surface tension F of the cleaning liquid 92 is 68.5 mN/m.

Note that the first area 661 that is shown in FIG. 2 measures 6 millimeters from left to right and 39 millimeters from front to rear, and the distance L from the nozzle face 111 to the bottom face of the first area 611 is 1.1 millimeters. In other words, the surface area S of the first area 661 in a plan view is 234 square millimeters, and the volume V of the first area 661 is 257.4 cubic millimeters. Accordingly, the volume V of the first area 661 is smaller than the volume V of the second area 662. Therefore, in the injection processing, if the cleaning liquid 92 soaks the nozzle face 111 in the second area 662 under the conditions (2) and (3), then it stands to reason that the cleaning liquid 92 will soak the nozzle face 111 in the first area 661 under the conditions (2) and (3).

Based on the confirmed results for the conditions (1) to (3) above, it is thought that in the injection processing, the cleaning liquid 92 will soak the nozzle face 111 under the conditions hereinafter described. Specifically, if the volumes V of the spaces within the cap 67 to which the suction pump 708 applies suction are reduced, the amount of the cleaning liquid 92 that is needed to fill the spaces will be reduced. Accordingly, it becomes easier for the cleaning liquid 92 to soak the nozzle face 111. Therefore, one of the surface area S and the distance L may be reduced in order to reduce the volume V. Reducing the distance L shortens the distance to the nozzle face 111, so that is desirable for soaking purposes.

Soaking also becomes easier in the injection processing if the first rotation speed is not less than 300 rpm, because the suction force with which the suction pump 708 draws the cleaning liquid 92 into the spaces inside the cap 67 becomes stronger. If the rotation speed of the suction pump 708 is less than the second rotation speed during the first purge at Step S13, then the amount of the ink 91 that is expelled from the nozzles 112 when the cleaning liquid 92 is injected into the cap 67 can be reduced from what it would be if the rotation speed of the suction pump 708 were the same as the second rotation speed at Step S13.

The cleaning liquid 92 also spreads more readily, and soaking becomes more difficult, if the surface tension F of the cleaning liquid 92 is less than 68.5 mN/m. Conversely, the cleaning liquid 92 becomes more resistant to spreading, and soaking becomes easier, if the surface tension F of the cleaning liquid 92 is not less than 68.5 mN/m. Note that the cleaning liquid 92 contains a surface active agent, and if the ratio of the surface active agent increases, the surface tension F becomes greater. The surface tension of the ink 91 is approximately 30 mN/m, and the surface tension F of the cleaning liquid 92 is higher than the surface tension of the ink 91.

At Step S12, the CPU 40 performs on/off operation of the suction pump 708. For example, after operating the suction pump 708 at that first rotation speed, the CPU 40 stops the suction pump 708. The CPU 40 may stop the suction pump 708 for 1 second, for example. Next, the CPU 40 operates the suction pump 708 once again at the first rotation speed. In a case where the suction pump 708 is a tube pump, the CPU 40 may operate the pump at the first rotation speed for two rotations, for example, but it is not limited to two rotations and may also operate the pump for one rotation and for more than two rotations. The CPU 40 operates the suction pump 708 intermittently at the first rotation speed for a total of seven sets of on/off operation. It is thus possible to reduce the possibility that the negative pressure will become too high. Note that the negative pressure becomes high means that the absolute value of the pressure decreases. Note also that during the on/off operation, the rotation speed and the stop times of the suction pump 708 do not need to be constant. The rotation speed may vary by several hundred rpm, and the stop time may vary by several seconds. The operation and the stopping are also not limited to seven sets and need only to be a plurality of sets. After repeating the on/off operation for seven sets, the CPU 40 terminates the injection processing at Step S20 and advances the processing to Step S21.

In the injection processing at Step S20, the suction force of the suction pump 708 causes the cleaning liquid 92 to flow from the cleaning liquid tank 705 to the first area 661 through the supply flow path 711, as shown in FIG. 14. The cleaning liquid 92 thus fills the first area 661 and soaks the nozzle face 111. When the cleaning liquid 92 soak the nozzle face 111, the part of the nozzle face 111 where the nozzle array 121 is located and the part of the cap 67 that is inside the first area 661 are cleaned by the cleaning liquid 92. And because the cleaning liquid 92 flows to the waste liquid tank 706 through the waste liquid flow paths 761, 763, the waste liquid flow paths 761, 763 are also cleaned.

Next, the CPU 40 performs hold processing (Steps S21 to S23). In the hold processing, the CPU 40 stops the suction pump 708 (Step S21). The CPU 40 closes the supply on-off valve 721 (Step S22) and closes the waste liquid on-off valve 771 (Step S23). Note that the CPU 40 also performs the processing at Steps S12 to S24 in the same manner for the second area 662. Therefore, the cleaning liquid 92 is supplied from the cleaning liquid tank 705 to the second area 662 of the cap 67 through the supply flow path 712, and the cleaning liquid 92 soaks the nozzle face 111 (Step S20). The cleaning liquid 92 that has been supplied to the cap 67 can thus be held inside the cap 67 in a state in which the cleaning liquid 92 soaks the nozzle face 111.

The head 110 of the head unit 200 discharges the color inks cyan, magenta, yellow, and black, so it is preferable for the cap 67 of the head unit 200 to have a separate area for each color, so as to avoid mixing the colors. However, if the composition of the black ink is different from the composition of the cyan, magenta, and yellow inks, the first area 661 may be provided in the cap 67 for the black ink only, with the second area 662 being provided for the cyan, magenta, and yellow inks. On the other hand, the head unit 100 discharges the white ink from all four of the nozzle arrays 121 to 124, so the cap 67 of the head unit 100 does not need to be divided into separate areas. However, in order to reduce the cost, it is preferable for the cap 67 of the head unit 100 to be the same as the cap 67 of the head unit 200. That would create the first area 661 and the second area 662 with different volumes, as described previously, so the soaking processing would be performed separately for the first area 661 and the second area 662. After performing Step S23, the CPU 40 stores the soaking flag and the time in the EEPROM 44 (Step S24). The CPU 40 returns the processing to Step S1.

De-Wetting Processing

Figure 15:
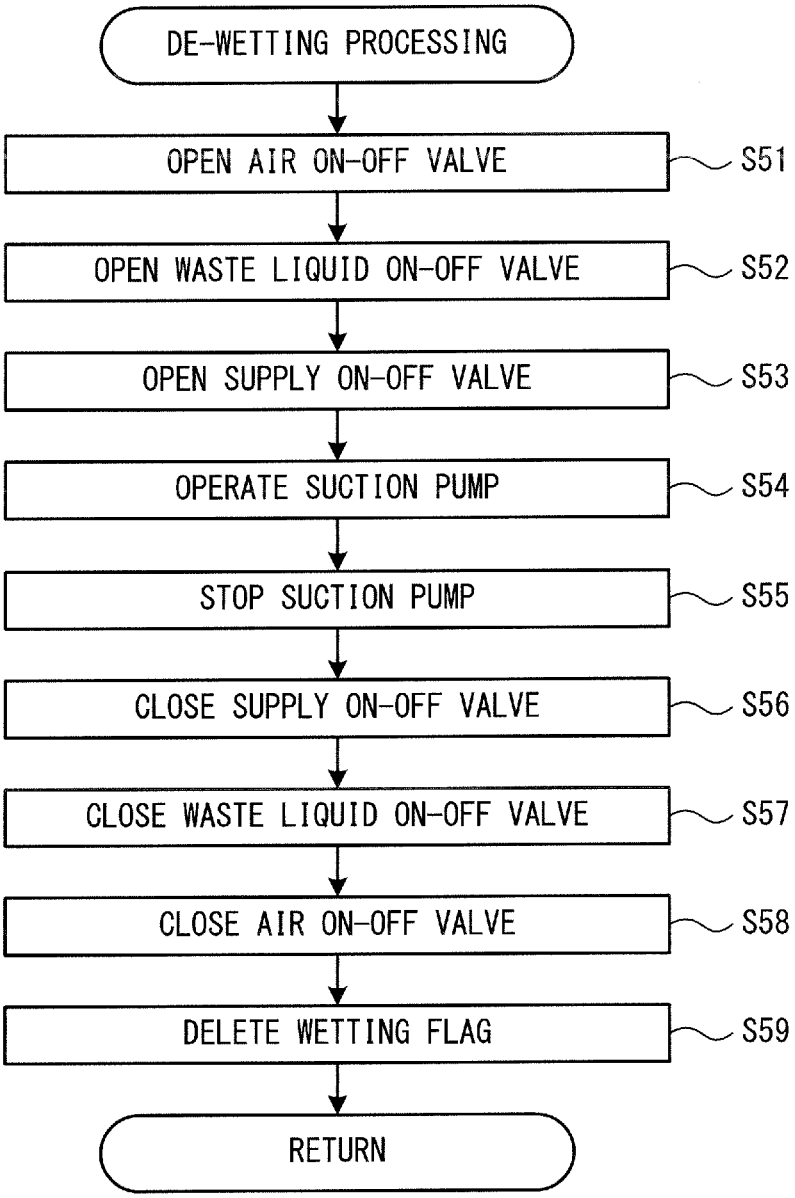
FIG. 15 is a flowchart of a subroutine of de-wetting processing.

The CPU 40 performs the de-wetting processing (Step S10) according to the subroutine that is shown in FIG. 15.

Figure 16:
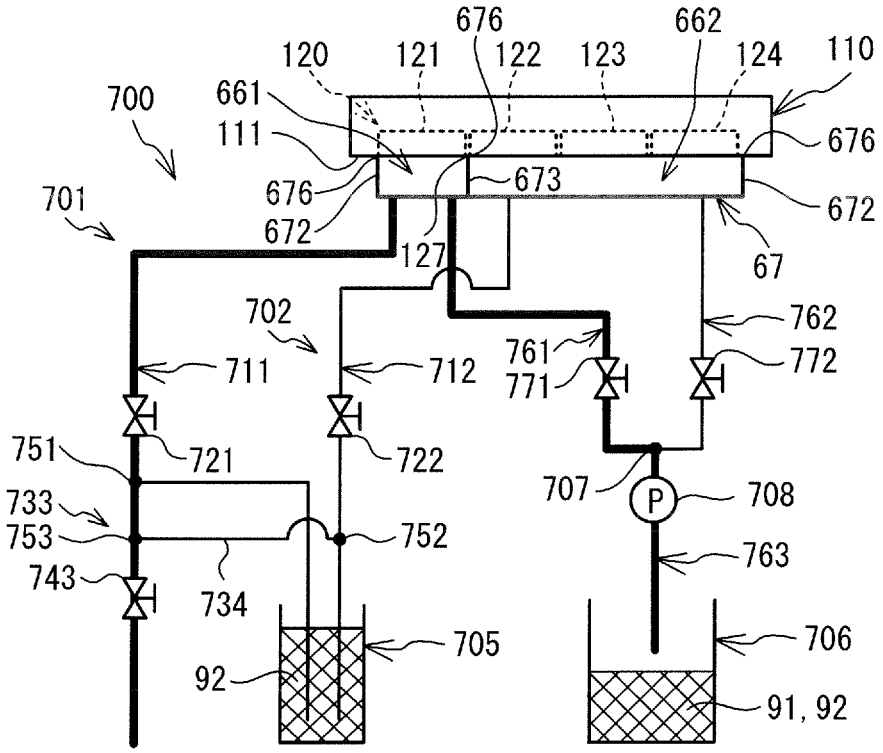
FIG. 16 is a schematic drawing of the maintenance flow path system that shows a state in which the cleaning liquid has been drained from the first area.

Note that the de-wetting processing (Step S10) is performed when the cap 67 is in the covering position. The CPU 40 opens the air on-off valve 743 (Step S51), opens the waste liquid on-off valve 771 (Step S52), and opens the supply on-off valve 721 (Step S53). Next, the CPU 40 operates the suction pump 708 at a fourth rotation speed (Step S54). The fourth rotation speed is 800 rpm, for example. In the processing at Step S54, discharge processing is performed that discharges the cleaning liquid 92 from the first area 661 through the waste liquid flow paths 761, 763 (Step S54). The suction force of the suction pump 708 causes air to flow into the first area 661 through the gas flow path 733 and also causes the cleaning liquid 92 in the first area 661 to be drained into the waste liquid tank 706 through the waste liquid flow paths 761, 763, as shown in FIG. 16. Next, the CPU 40 stops the suction pump 708 (Step S55). The CPU 40 closes the supply on-off valve 721 (Step S56), closes the waste liquid on-off valve 771 (Step S57), and closes the air on-off valve 743 (Step S58). The CPU 40 deletes the soaking flag from the EEPROM 44 (Step S59).

Print Time Processing

Figure 17:
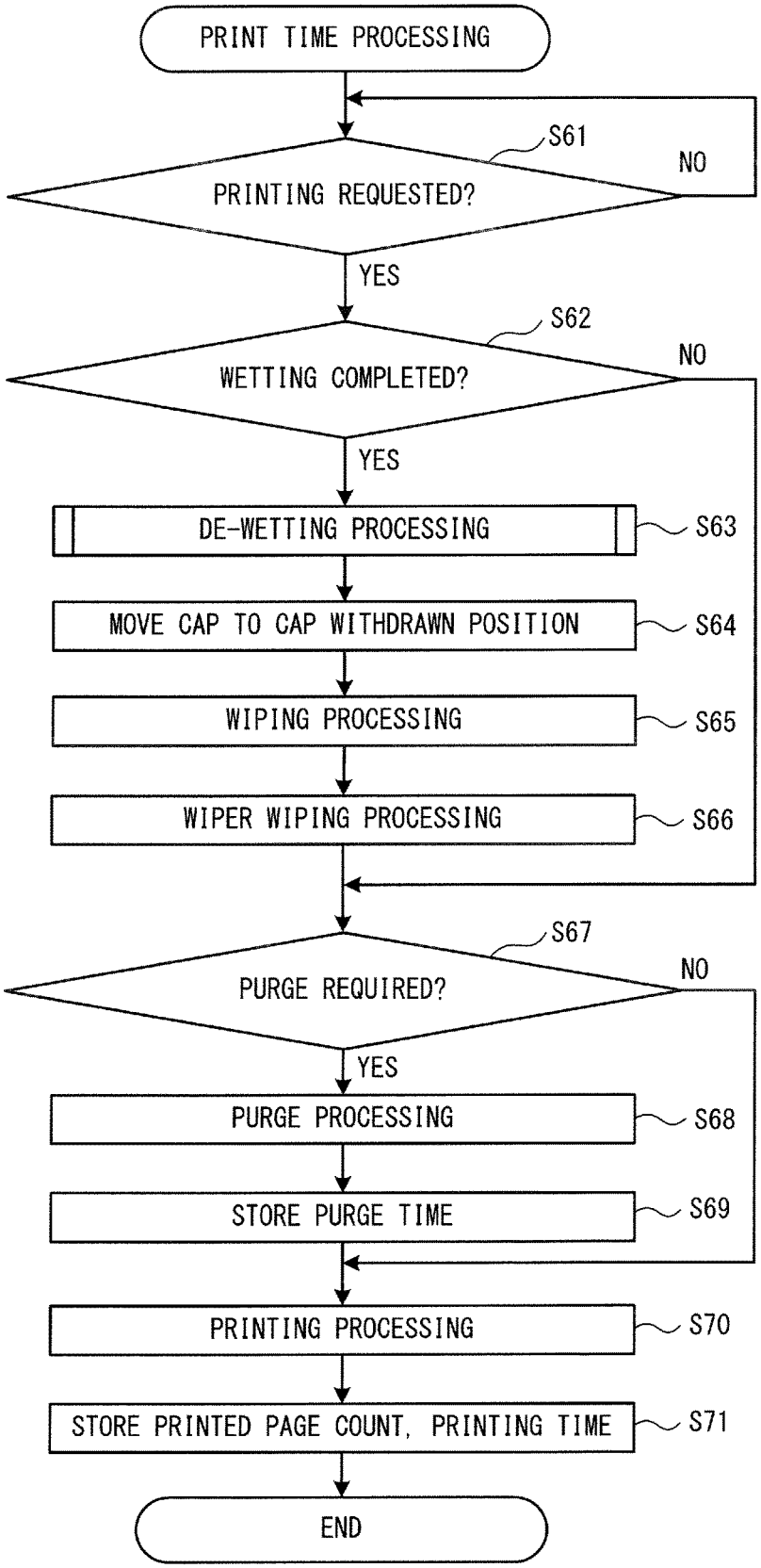
FIG. 17 is a flowchart of print time processing.

The CPU 40 performs print time processing according to the flowchart that is shown in FIG. 17. The CPU 40 performs first determination processing (Step S61), which determines whether a print request has been received. The CPU 40 receives a print request from the operation processing portion 50 based on an operation of the operation buttons 501. The CPU 40 may also receive a print request from the computer (not shown in the drawings) that is connected to the USB connector 47. In a case where the CPU 40 has not received a print request (NO at Step S61), the CPU 40 returns the processing to Step S61. If the CPU 40 determines that a print request has been received (YES at Step S61), the CPU 40 determines whether soaking has been completed (Step S62). In a case where the soaking flag is stored in the EEPROM 44, the CPU 40 determines that soaking has been completed (YES at Step S62) and performs the de-wetting processing (Step S63). The CPU 40 performs the de-wetting processing (Step S63) according to the subroutine that is shown in FIG. 15 (Steps S51 to S59). In a case where the CPU 40 does not determine that soaking has been completed (NO at Step S62), the CPU 40 does not perform the de-wetting processing (Step S63), but instead determines whether purging is required (Step S67). After performing the de-wetting processing (Step S63), the CPU 40 moves the cap 67 from the covering position to the cap withdrawn position (refer to FIG. 7) (Step S64). Next, the CPU 40 performs the wiping processing (Step S65). Next, the CPU 40 performs the wiper wiping processing (Step S66). Next, the CPU 40 determines whether purging is required (Step S67).

For example, the CPU 40 determines whether purging is required (Step S67) based on the page count of the pages printed since the most recent ink purge operation, which is stored in the EEPROM 44. For example, if the page count since the most recent ink purge operation is not less than 20, the CPU 40 determines that purging is required (YES at Step S67). Next, the CPU 40 performs purge processing (Step S68). The purge processing that the CPU 40 performs for the first area 661 (Step S68) is the same as the first purge that is shown in FIG. 10 (Steps S12 to S14). The purge processing that the CPU 40 performs for the second area 662 (Step S68) is also the same as the first purge that is shown in FIG. 10 (Steps S12 to S14).

Next, the CPU 40 takes the current time and stores the current time in the EEPROM 44 as the time of the most recent ink purge operation (Step S69). Next the CPU 40 performs the printing processing (Step S70). In the printing processing, the CPU 40, by controlling the heads 110 through the head drive portion 43, performs the printing that discharges the inks 91 from the nozzles 112 (Step S70). Next, the CPU 40 stores the printed page count in the EEPROM 44, along with the current time as the time of the most recent printing (Step S71). The CPU 40 then terminates the printing processing.

Power Off Time Processing

Figure 18:
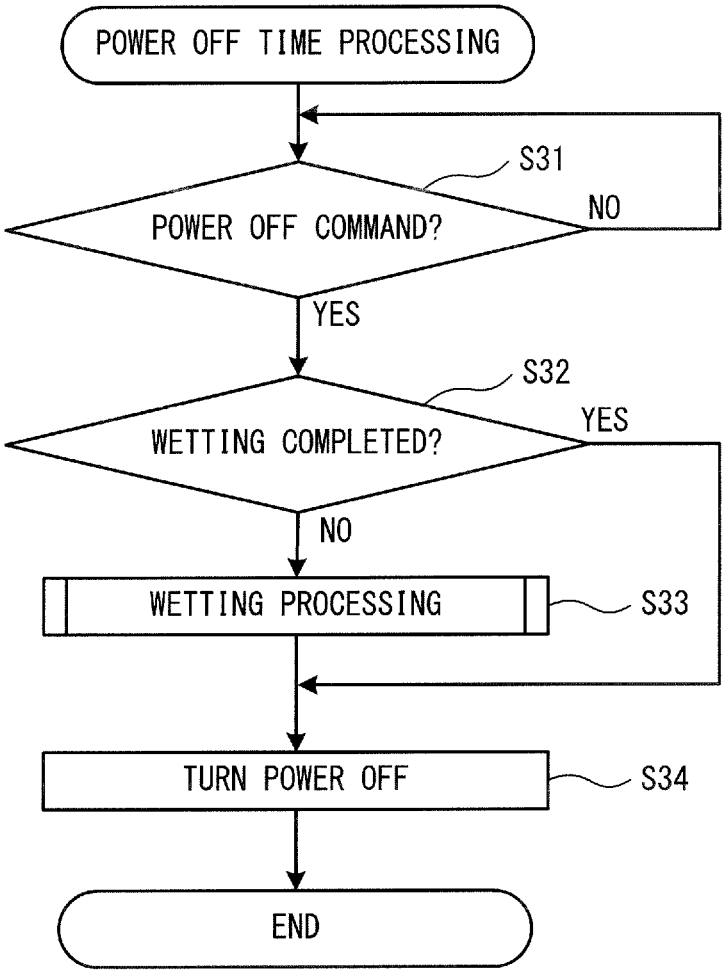
FIG. 18 is a flowchart of power off time processing.

When the power supply to the printer 1 is turned off, the CPU 40 performs power off time processing, which is shown in FIG. 18. The CPU 40 first performs third determination processing (Step S31), which determines whether a power off command to turn off the power supply 56 has been received. When the operation buttons 501 are operated to issue the power off command to the CPU 40 (YES at Step S31), the CPU 40 determines whether soaking has been completed (Step S32). In a case where soaking has been completed, for example, the soaking flag is stored in the EEPROM 44 (refer to Step S24 in FIG. 10). Accordingly, in a case where the soaking flag is stored in the EEPROM 44, the CPU 40 determines that soaking has been completed (YES at Step S32). The CPU 40 then uses the power supply control portion 57 to turn off the supply of the electric power from the power supply 56, thus putting the printer 1 into a power off state (Step S34) without performing the soaking processing (Step S33). In a case where the CPU 40 does not determine that soaking has been completed (NO at Step S32), the CPU 40 performs the soaking processing (Step S33). The CPU 40 performs the soaking processing (Step S33) according to the subroutine that is shown in FIG. 10 (Steps S11 to S24). After the soaking processing (Step S33), the CPU 40 uses the power supply control portion 57 to turn off the supply of the electric power from the power supply 56 (Step S34). In a case where a power off command has not been issued to the CPU 40 (NO at Step S31), the CPU 40 returns the processing to Step S31.

As described previously, in the soaking processing that is shown in FIG. 10, the CPU 40 performs the covering control processing (Step S11), which puts the cap 67 into the covering state, in which it covers the nozzle face 111. After performing the covering control processing (Step S11), the CPU 40 opens the supply on-off valves 721, 722 (Step S19) and performs the supply processing (Step S20), which operates the suction pump 708 to supply the cleaning liquid 92 from the supply flow paths 711, 712 to the cap 67. After performing the supply processing (Step S20), in a state in which the cleaning liquid 92 has soaked the nozzle face 111, the CPU 40 closes the supply on-off valves 721, 722 (Step S22) and stops the suction pump 708 (Step S21). The hold processing (Steps S21 to S23) is thus performed, maintaining a state in which the cleaning liquid 92 is left in the cap 67 and is in contact with the nozzle face 111. After performing the hold processing, the CPU 40 performs the first determination processing (Step S61), which determines whether a print request has been received. In a case where the power on signal has been detected, and in a case where the first determination processing (Step S61) has determined that a print request has been received (YES at Step S61), the CPU 40 performs the discharge processing (Step S54), which operates the suction pump 708 to discharge, through the waste liquid flow paths 761, 762, 763, the cleaning liquid 92 that has been left in contact with the cap 67.

Therefore, in the printer 1, in a case where the power supply 56 has not been turned on, or in a case where a print request has not been received, the nozzle face 111 is soaked by the cleaning liquid 92, so the cleaning liquid 92 makes its way into the nozzles 112. The possibility that the inks 91 will clog the nozzles 112 can thus be reduced. That, in turn, reduces the possibility that a discharge failures will occur due to the clogging. Furthermore, because the nozzles 112 are left in a covered state, the possibility can be reduced that the nozzles 112 will be clogged due to the drying of the inks 91, which would give rise to failures in the discharging of the inks 91. The possibility that the cleaning liquid 92 will leak to the outside of the cap 67 can also be reduced. Moreover, in a case where the power supply 56 has been turned on from the power off state, or in a case where the first determination processing (Step S61) has determined that a print request has been received (YES at Step S61), the cleaning liquid 92 is promptly discharged from the cap 67 by the discharge processing (Step S54), so the next operation can be performed promptly.

In the cycle processing that is shown in FIG. 9, the CPU 40 performs the second determination processing. In the second determination processing, for example, the CPU 40 determines whether a specified length of time has elapsed since the inks 91 were discharged from the nozzles 112. Specifically, for example, in a case where the CPU 40 does not determine that the elapsed time since the most recent printing processing (Step S70) is less than the time Ta (NO at Step S4), that is, in a case where the CPU 40 has determined that the time Ta has elapsed (NO at Step S4), the CPU 40 determines whether the elapsed time since the most recent purge processing is less than the time Tb (Step S5). In a case where the CPU 40 does not determine that the elapsed time since the most recent purge processing is less than the time Tb (NO at Step S5), that is, where the CPU 40 has determined that the time Tb has elapsed (NO at Step S5), the CPU 40 performs the soaking processing (Step S8). In a case where the cap 67 is in the cap withdrawn position before the soaking processing is performed, as shown in FIG. 7, the CPU 40 starts the soaking processing (Step S8) by performing the covering control processing (Step S11). The covering control processing controls the cap 67 into the covering state, in which it covers the nozzle face 111. Therefore, in a case where the specified length of time has elapsed since the inks 91 were discharged from the nozzles 112, that is, in a case where the inks 91 have been held in the nozzles 112 for at least the specified length of time without being discharged, the possibility can be reduced that the nozzles 112 will be clogged due to the drying of the inks 91 that have been held in the nozzles 112, which would give rise to discharge failures in the nozzles 112. Note that the second determination processing has been described as the determination that the time Ta has elapsed since the most recent printing processing (NO at Step S4) and the determination that the time Tb has elapsed since the most recent purge processing (NO at Step S5). However, it is also acceptable for the second determination processing to include only one of these two determinations.

Assume that only one of the determination that the time Ta has elapsed since the most recent printing processing (NO at Step S4) and the determination that the time Tb has elapsed since the most recent purge processing (NO at Step S5) has been made. In that case, there are two possibilities. The first possibility is that the time Ta has elapsed since the most recent printing processing, but the purge processing has been performed during that time. The second possibility is that the time Tb has elapsed since the most recent purge processing, but the printing processing has been performed during that time. In both of those cases, the inks 91 have been discharged from the nozzles 112, so the possibility is low that discharge failures will occur in the nozzles 112. On the other hand, in the second determination processing, there are two cases in which the CPU 40 does determine that the specified length of time has elapsed. The first case is where the CPU 40 does not determine that the elapsed time since the most recent printing processing (Step S70) is less than the time Ta (NO at Step S4), that is, a case where the printing processing has not been performed within the time Ta. The second case is where the CPU 40 does not determine that the elapsed time since the most recent purge processing (Step S68) is less than the time Tb (NO at Step S5), that is, a case where a purge has not been performed within the time Tb since the most recent purge processing (Step S68). When the CPU 40 determines that the specified length of time has elapsed (NO at Step S4; NO at Step S5), the CPU 40 performs the soaking processing (Step S8) and controls the cap 67 into the covering state, in which the cap 67 covers the nozzle face 111 (Step S11). The CPU 40 is therefore able to perform the soaking processing after determining more accurately that the inks 91 have been held in the nozzles 112 for at least the specified length of time.

The printer 1 is provided with the power supply 56, which supplies the electric power. In the power off time processing that is shown in FIG. 18, the CPU 40 determines, in the third determination processing, whether the power off command to turn off the power supply 56 has been received (Step S31). When the CPU 40 determines that the power off command has been received (YES at Step S31), the CPU 40 performs the soaking processing (Step S33). In the soaking processing (Step S33), the CPU 40, in the covering control processing (Step S11), controls the cap 67 into the covering state, in which the cap 67 covers the nozzle face 111. When the power supply 56 is turned off, in a case where the specified length of time has elapsed or the like, there is thought to be a strong possibility that the inks 91 will be held in the nozzles 112 for a long time without being discharged. In a case where the power off command has been received, the soaking processing is performed, so the soaking processing is performed by the time that the specified length of time elapses. That reduces the possibility that the inks 91 that are being held in the nozzles 112 without being discharged will dry out. That, in turn, can reduce the possibility that the nozzles 112 will be clogged due to the drying of the inks 91, which would give rise to failures in the discharging of the inks 91.

In the soaking processing that is shown in FIG. 10, the CPU 40 closes the supply on-off valves 721, 722 (Step S22) after stopping the suction pump 708 (Step S21) in a state in which the cleaning liquid 92 has soaked the nozzle face 111. That is more effective in reducing the possibility that the pressure that the suction pump 708 generates within the flow paths will hinder the opening and closing of the supply on-off valves 721, 722 than would be the case if the suction pump 708 were to be stopped after the supply on-off valves 721, 722 are closed. Furthermore, the liquids and gases that are drawn by the suction force of the suction pump 708 do not abruptly accelerate or abruptly stop. That makes it possible to reduce any effect on the nozzle face 111 and any variation in the amounts of the inks 91 that are drawn out of the nozzles 112, which in turn makes it possible to maintain the soaking state more reliably.

In the de-wetting processing that is shown in FIG. 15, the CPU 40 performs the discharge processing by opening the air on-off valve 743, then operating the suction pump 708 (Step S54) to discharge the cleaning liquid 92 from inside the cap 67. That is more effective in reducing the possibility that the pressure that the suction pump 708 generates within the flow paths will hinder the opening and closing of the air on-off valve 743 than would be the case if the air on-off valve 743 were opened after the suction pump 708 was operated. When the air on-off valve 743 is opened before the suction pump 708 is operated, there is a possibility that the liquid will flow toward the air on-off valve 743. However, because the suction pump 708 will be operated, the suction force of the suction pump 708 reduces the possibility that the liquid will flow toward the air on-off valve 743.

In the print time processing that is shown in FIG. 17, the CPU 40, after performing the de-wetting processing (Step S63) and before performing the printing processing (Step S70), closes the air on-off valve 743 and the supply on-off valves 721, 722 and performs the purge processing (Step S68). The purge processing operates the suction pump 708 at the second rotation speed, which is faster than the first rotation speed of the suction pump 708 during the supply processing (Step S20). When the suction pump 708 is operated at the second rotation speed, the resulting suction force makes the negative pressure inside the cap 67 greater than it is when the suction pump 708 is operated at the first rotation speed. It is thus easier to draw out the cleaning liquid 92 that has made its way into the nozzles 112. It is therefore possible to reduce the drop in the printing quality that occurs when the cleaning liquid 92 mixes with the inks 91 that are discharged from the nozzles 112 during the printing processing. On the other hand, because the first rotation speed of the suction pump 708 during the supply processing (Step S20) is slower than the second rotation speed during the purge processing (Step S68), the ratio of the ink 91 in the liquid that is left in the cap 67 during the hold processing is thought to decrease. This reduces the possibility that the nozzles 112 will be clogged by the ink 91 that remains in the cap 67 and also reduces the possibility that the ink 91 will clog the flow paths from the cap 67 to the waste liquid tank 706 during the de-wetting processing.

In the cycle processing that is shown in FIG. 9, when the CPU 40 determines that the time Tc has elapsed since the most recent soaking processing (YES at Step S9), the CPU 40 performs the de-wetting processing (Step S10), which discharges the cleaning liquid 92 that has been held inside the cap 67. Thereafter, the CPU 40 is able to supply the cleaning liquid 92 to the cap 67 (Step S20) and perform the soaking processing (Step S8), which holds the cleaning liquid 92 inside the cap 67. Therefore, the cleaning liquid 92 can be newly supplied to the cap 67 at intervals of the time Tc, reducing the possibility of failures in the discharging of the inks 91 due to clogging of the nozzles 112.

The present disclosure is not limited to the embodiment that is described above, and various types of modifications can be made. For example, in the soaking processing that is shown in FIG. 10, the suction pump 708 may be operated (Step S13) before the supply on-off valves 721, 722 are opened (Step S12), and it may also be operated at the same time as the opening of the supply on-off valves 721, 722. The suction pump 708 may also be operated (Step S16) before the air on-off valve 743 is opened (Step S15), and it may also be operated at the same time as the opening of the air on-off valve 743. The suction pump 708 may also be operated (Step S20) before the air on-off valve 743 is closed (Step S15) and the supply on-off valves 721, 722 are opened (Step S19), and it may also be operated at the same time as the closing of the air on-off valve 743 and the opening of the supply on-off valves 721, 722. The processing at Steps S12 to S17 also does not necessarily have to be performed. Furthermore, in the printing processing that is shown in FIG. 17, when the CPU 40 has determined that soaking has been completed (Step S62), after performing the de-wetting processing (Step S63), the CPU 40 may flush the inks 91 from the nozzles 112 and perform the printing processing (Step S70), all without performing the determination processing as to whether purging is required (Step S67), without performing the purge processing (Step S68), and without storing the time of the purge in the EEPROM 44 (Step S69).

In the soaking processing that is shown in FIG. 10, the processing at Steps S12 to S14 and the purging of the nozzles 112 may be performed first for the second area 662, after which the processing at Steps S12 to S14 and the purging of the nozzles 112 may be performed for the first area 661. In that case, the supply processing (Step S20) would be performed first for the nozzles 112 in the first area 661 and then performed for the nozzles 112 in the second area 662. The soaking processing could thus be performed more efficiently, because the number of times that the air on-off valve 743 is switched between open and closed, the number of times that the suction pump 708 is started and stopped, the control that changes the rotation speed of the suction pump 708, the number of times that the head 110 moves, and the number of times that the cap 67 moves up and down would all be decreased.

In the soaking processing, instead of operating the suction pump 708 intermittently (Step S20), the CPU 40 may introduce air into the interior of the cap 67 by operating the suction pump 708 continuously and opening the air on-off valve 743 for a fixed time interval. In the soaking processing that is shown in FIG. 10, the processing at Steps S12 to S23 is first performed for the first area 661, after which the processing at Steps S12 to S23 is performed for the second area 662. However, the processing at Steps S12 to S23 may also be performed first for the second area 662, after which the processing at Steps S12 to S23 may be performed for the first area 661. The processing at Steps S12 to S23 may also be performed at the same time for the first area 661 and the second area 662. The power on command and the power off command may also be received from the computer that is connected to the USB connector 47.

It is also acceptable for the partition wall 673 not to be provided in the cap 67. In that case, the first area 661 and the second area 662 would also cease to exist, so it would be possible to inject the cleaning liquid 92 into the interior of the cap 67 only once, and to remove the cleaning liquid 92 only once. The number of the partition walls 673 is also not limited. For example, three of the partition walls 673 may be provided in the cap 67, and three of the partition walls 673 may be affixed tightly to the corresponding boundaries between the plurality of the nozzle arrays 121 to 124. In a case where the partition wall 673 is not provided, it would not be necessary to provide both the first flow path system 701 and the second flow path system 702, and a single flow path system would be preferable.

It is also acceptable not to provide the waste liquid on-off valves 771, 772. It is also acceptable not to provide the waste liquid tank 706. The ink 91 that is discharged from the nozzles 112 may also be a discharge agent that decolorizes a dyed cloth, for example.

The opposite end of the gas flow path 733 from the cap 67 is open to the atmosphere, but it may also be connected to a tank in which a gas is stored. In that case, the tank may also store a gas other than air. A gas flow path may be connected to each one of the supply flow paths 711, 712, and an air on-off valve may be provided in each one of the gas flow paths. The first rotation speed, the second rotation speed, the third rotation speed, the fourth rotation speed, the specified time, the specified length of time, the time Ta, the time Tb, and the time Tc are not limited to the numerical values in the embodiment that is described above.

One of all and a part of the control program that performs the processing that is described above may be stored in the ROM 41. That is, the control program can be stored in any type of storage device that can be read by the CPU 40. Typically, the storage device is a non-transitory storage medium such as a hard disk drive (HDD) or the like. The non-transitory storage medium does not need to include a transitory storage medium such as a transmission signal or the like. The control program may also be downloaded through a network such as the Internet or the like and then stored in the ROM 41.

The processor of the present disclosure is not limited to the CPU 40, and the CPU 40 may also be another electronic device, such as an application specific integrated circuit (ASIC) or a field programmable gate array (FPGA), for example. That is, an ASIC, for example, can be used instead of the CPU 40, the ROM 41, the RAM 42, and the EEPROM 44. The functions of the processor of the present disclosure may also be distributed among a plurality of electronic devices, such as a plurality of CPUs or the like. The individual steps in the flowchart that is described above may also be performed by distributed processing among a plurality of electronic devices.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A print device comprising:

a head provided with a nozzle face having a nozzle;

a cap configured to be affixed to the nozzle face and cover the nozzle;

a supply flow path connected to the cap and configured to supply a cleaning liquid to the interior of the cap;

a supply valve provided in the supply flow path and configured to open and close the supply flow path;

a waste liquid flow path connected to the cap and configured to drain off the cleaning liquid that has been supplied to the interior of the cap;

a pump connected to the waste liquid flow path;

a processor; and a memory storing computer-readable instructions which, when executed by the processor, perform processes including:

covering control processing controlling the cap into a covering state in which the cap covers the nozzle;

supply processing supplying, after the covering control processing, the cleaning liquid to the cap from the supply flow path by opening the supply valve and operating the pump;

hold processing holding, after the supply processing and in a state in which the cleaning liquid has soaked the nozzle face, the cleaning liquid in the cap by closing the supply valve and stopping the pump;

first determination processing determining, after the hold processing, whether a print request has been received; and discharge processing discharging, in a case where a power on signal has been detected or in a case where the first determination processing has determined that the print request has been received, the cleaning liquid that has been held in the cap to the waste liquid flow path by operating the pump.

2. The print device according to claim 1, wherein the computer-readable instructions, when executed by the processor, further perform processes including:

second determination processing determining whether a first time period has elapsed since an ink was discharged from the nozzle, wherein the covering control processing includes controlling the cap into the covering state in a case where the second determination processing has determined that the first time period has elapsed.

3. The print device according to claim 2, wherein the second determination processing includes determining that the first time period has elapsed in a case where printing has not been performed for at least a second time period and purging has not been performed for at least a third time period.

4. The print device according to claim 1, further comprising:

a power supply configured to supply electric power, wherein the computer-readable instructions, when executed by the processor, further perform processes including:

third determination processing determining whether a power off command to turn off the power supply has been received, wherein the covering control processing includes controlling the cap into the covering state in a case where the third determination processing has determined that the power off command has been received.

5. The print device according to claim 1, wherein the hold processing includes holding, in the state in which the cleaning liquid has soaked the nozzle face, the cleaning liquid in the cap by closing the supply valve after stopping the pump.

6. The print device according to claim 1, further comprising:

a gas flow path connected to one of the cap and the supply flow path; and an air valve configured to open and close the gas flow path, wherein the discharge processing includes discharging the cleaning liquid by opening the air valve and operating the pump.

7. The print device according to claim 6, wherein the computer-readable instructions, when executed by the processor, further perform processes including:

purge processing closing the air valve and the supply valve and operating the pump at a second rotation speed after the discharge processing and before printing processing, the second rotation speed being faster than a first rotation speed of the pump during the supply processing.

8. The print device according to claim 6, wherein the hold processing includes:

discharging the cleaning liquid that has been held in the cap in a case where a fourth time period has elapsed;

resupplying a cleaning liquid to the cap after discharging the cleaning liquid that has been held in the cap; and holding the resupplied cleaning liquid inside the cap.

* * * * *